US012540481B2

(12) United States Patent
Zeng et al.

(10) Patent No.: US 12,540,481 B2
(45) Date of Patent: Feb. 3, 2026

(54) POOL HAVING BUILT-IN SEAT

(71) Applicant: BESTWAY INFLATABLES & MATERIAL CORP., Shanghai (CN)

(72) Inventors: Xianglin Zeng, Shanghai (CN); Yunzhe Ban, Shanghai (CN); Chenggen Liu, Shanghai (CN); Qingshui Song, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 55 days.

(21) Appl. No.: 18/095,258

(22) Filed: Jan. 10, 2023

(65) Prior Publication Data

US 2024/0003152 A1 Jan. 4, 2024

(30) Foreign Application Priority Data

Jul. 4, 2022 (CN) ..... 202210780475.1
Jul. 4, 2022 (CN) ..... 202221703933.3
Jul. 27, 2022 (CN) ..... 202221946849.4

(51) Int. Cl.
*E04H 4/14* (2006.01)
*E04H 4/00* (2006.01)

(52) U.S. Cl.
CPC ..... *E04H 4/0025* (2013.01); *E04H 4/14* (2013.01)

(58) Field of Classification Search
CPC ..... E04H 4/0025; E04H 4/14
USPC ..... 4/506
See application file for complete search history.

(56) References Cited

U.S. PATENT DOCUMENTS 2,582,439 A * 1/1952 Kavanagh ..... A47K 3/12 4/575.1
5,020,168 A 6/1991 Wood
6,357,061 B1 * 3/2002 Gonzalez ..... A47K 3/12 4/581
6,378,147 B1 * 4/2002 Halleran ..... A47K 3/122 4/583
6,715,164 B2 * 4/2004 Steadman ..... A61G 7/1088 4/565.1
2020/0060481 A1 2/2020 Huang et al.
2021/0108431 A1 4/2021 Haung et al.
2023/0243172 A1 * 8/2023 Huang ..... A61H 33/02 4/541.1
2024/0423871 A1 * 12/2024 Zeng ..... A61H 33/027

OTHER PUBLICATIONS

Extended European Search Report dated Dec. 11, 2023 (Dec. 11, 2023), 8 pages, issued on related European Patent Application 23156391.7 by the European Patent Office.

* cited by examiner

*Primary Examiner* — Huyen D Le
(74) *Attorney, Agent, or Firm* — Dickinson Wright PLLC

(57) ABSTRACT

An inflatable pool having a built-in seat is provided. The inflatable pool may include: a pool body comprising a bottom wall and a side wall, together defining a water-holding space; and an inflatable stool disposed in a water-holding space. The inflatable stool may include a top sheet, a side enclosure sheet, and an inflation chamber defined by the top sheet and the side enclosure sheet. The inflatable stool may be fixedly connected to the bottom wall or may be connected to the bottom wall in a detachable manner.

10 Claims, 18 Drawing Sheets

POOL HAVING BUILT-IN SEAT

CROSS-REFERENCE TO RELATED APPLICATION

This application claims priority from Chinese Application CN 202210780475.1, filed Jul. 4, 2022; Chinese Application CN 202221703933.3, filed Jul. 4, 2022; and Chinese Application CN 202221946849.4, filed Jul. 27, 2022, the disclosures of which are incorporated herein by reference in their entireties.

BACKGROUND

1. Field

Apparatuses and methods consistent with exemplary embodiments relate to inflatable pools, and in particular to an inflatable pool having a built-in seat.

2. Description of the Related Art

At present, a conventional inflatable pool typically comprises a pool bottom and an inflatable pool wall, which together define a space for holding water. Some inflatable pools can also provide a massage function by supplying water or air into the water, and a user can sit in the water to get a massage. However, because the pool bottom is usually in contact with the hard ground, it is not comfortable for the user to sit on the pool bottom if the pool bottom provides insufficient support for the user.

Additionally, it has been realized that because massage nozzles are provided on an inner wall or a bottom of a pool body, an existing massage pool can only massage the back, waist or soles of a user, and accordingly the user cannot completely relax. In addition, in some existing products, reclining chairs are provided in SPA pools to provide users with a rest. However, in these SPA pools, bubble-generating belts are only provided at the bottoms of the pools close to the pool walls, no massage passages are provided on the reclining chairs, and the bubble-generating belts close to the pool walls only provide a massage effect on the vicinity, so that the users on the reclining chairs cannot experience the massage effect.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, an inflatable pool comprises: a pool body comprising a bottom wall and a side wall, wherein the bottom wall and the side wall together define a water-holding space; and an inflatable stool disposed in the water-holding space, the inflatable stool comprising: a top sheet, a side enclosure sheet, and an inflation chamber defined by the top sheet and the side enclosure sheet, wherein the inflatable stool is one of detachably connected to the bottom wall and fixedly attached to the bottom wall by a connecting portion disposed along a circumference of the inflatable stool.

The inflatable stool may further comprise a bottom sheet; opposite sides of the side enclosure sheet may be respectively connected to the top sheet and the bottom sheet; and the inflation chamber may be defined by the top sheet, the side enclosure sheet, and the bottom sheet.

The connecting portion may be a circumferential extension of the bottom sheet disposed along an outer circumferential side of a seam between the bottom sheet and the side enclosure sheet.

The connecting portion may be a circumferential extension of the bottom sheet and may extend along an entire circumference of the inflatable stool.

The connecting portion may be a circumferential extension of the bottom sheet; wherein the inflatable pool may further comprise an attachment sheet disposed between the inflatable stool and the bottom wall, and comprise an integral attachment portion shaped to correspond to a shape of the connecting portion, wherein the connecting portion is connected to the attachment sheet along a seam, and wherein the attachment portion is disposed along an outer circumferential side of the seam between the connecting portion and the attachment sheet, and wherein the attachment portion is connected to the bottom wall.

Both the connecting portion and the attachment portion may extend along an entire circumference of the inflatable stool.

The connecting portion may comprise an extension of the side enclosure sheet, and the side enclosure sheet may be connected to the top sheet, and the connecting portion may be connected to the bottom wall, so that the top sheet, the side enclosure sheet, and the bottom wall together define the inflation chamber.

The connecting portion may comprise an extension of the side enclosure sheet along a bottom edge of the side enclosure sheet, and the connecting portion may extend along an entire circumference of the inflatable stool.

The connecting portion may be connected to the bottom wall by one of welding and bonding.

The inflatable stool may further comprise a bottom sheet; opposite sides of the side enclosure sheet may be respectively connected to the top sheet and the bottom sheet; the inflation chamber may be defined by the top sheet, the side enclosure sheet, and the bottom sheet; and the inflatable stool may be detachably connected to the bottom wall.

The inflatable stool may further comprise a tensioning member disposed within the inflation chamber and connected to the top sheet and to one of the bottom sheet and the bottom wall.

A cross-sectional shape of the inflatable stool may be one of circular circle, an oval, an open ring, a closed ring, and a polygon.

The inflatable pool may further comprise an inflatable backrest connected to the inflatable stool.

The side wall may be inflatable.

According to an aspect of another example embodiment, a method for manufacturing an inflatable pool may comprise: providing a pool body comprising a bottom wall; providing a top sheet and a side enclosure sheet of an inflatable stool; and assembling the inflatable stool such that an inflation chamber of the inflatable stool is defined by the top sheet and the side enclosure sheet and a connecting portion is disposed along a circumference of the inflatable stool, and connecting the connecting portion to the bottom wall.

The connecting the connecting portion may comprise fixedly connecting the connecting portion to the bottom wall.

The method may further comprise providing a bottom sheet of the inflatable stool, wherein the assembling the inflatable stool comprises connecting the side enclosure sheet to the top sheet; and connecting the side enclosure sheet to the bottom sheet, so that the top sheet, the bottom sheet, and the side enclosure sheet together define the inflation chamber of the inflatable stool.

The connecting portion may comprise an extension of the bottom sheet; and wherein the assembling of the inflatable stool comprises connecting the bottom sheet to the side enclosure sheet, so that the connecting portion is disposed along an outer circumferential side of a seam between the bottom sheet and the side enclosure sheet.

The connecting portion may comprise an extension of the bottom sheet; wherein the pool body further comprises an attachment sheet comprising an integral attachment portion shaped to correspond to a shape of the connecting portion; wherein the connecting the connection portion comprises connecting the connecting portion to the attachment sheet along a seam, so that the attachment portion is disposed along an outer circumferential side of the seam between the connecting portion and the attachment sheet; and the method further comprises connecting the attachment portion to the bottom wall.

The connecting portion may comprise an extension of the side enclosure sheet; and the connecting the connecting portion to the bottom wall comprises defining the inflation chamber by the top sheet, the side enclosure sheet, and the bottom wall.

The method may further comprise: providing a tensioning member of the inflatable stool; and the assembling the inflatable stool further comprises disposing the tensioning member in the inflation chamber and connecting the tensioning member to the top sheet and one of the bottom sheet and the bottom wall.

According to an aspect of another example embodiment, a massage pool may comprise: a pool body comprising a pool bottom and a side wall, the pool bottom comprising a first air passage therein, wherein the pool bottom and the side wall together define a water-holding space; a seat disposed in the water-holding space and comprising therein a second air passage in fluid communication with the first air passage; and a seat bubble-generating sheet disposed on the seat and comprising a plurality of holes therethrough, wherein air entering from the first air passage flows to and is ejected out through the plurality of through holes in the seat bubble-generating sheet through the second air passage.

The seat bubble-generating sheet may be disposed on a top outer surface of the seat and has a shape corresponding to a contour of the top outer surface of the seat, and wherein a gap is disposed between the seat bubble-generating sheet and the top outer surface of the seat, thereby forming a second bubble-generating passage.

The seat may comprise an air chamber defined by a seat top sheet, a seat bottom sheet, and a seat surrounding sheet, and the second air passage is disposed in the air chamber of the inflatable seat, wherein a first end of the second air passage is fixedly connected to the seat surrounding sheet, a second end of the second air passage is fixedly connected to the seat top sheet, and the seat top sheet and the seat surrounding sheet each comprise a communicating hole that is in fluid communication with the second air passage.

The second air passage may comprise a pipe, wherein a first end of the pipe comprises a first connection interface fixedly connected to the seat top sheet by means of a first threaded fastener, and a second end of the pipe comprises a second connection interface fixedly connected to the seat surrounding sheet by means of a second threaded fastener.

The second air passage may comprise a sleeve and a pipe disposed within the sleeve, wherein a first end of the sleeve is connected to the seat top sheet by welding and a second end of the sleeve is connected to the seat surrounding sheet by welding.

The massage pool may further comprise an air outlet nozzle disposed at an end of the pipe facing the seat top sheet.

A hardness of the pipe may be greater than a hardness of the sleeve.

The massage pool may further comprise an air inlet bag comprising a first opening fixedly connected to and in fluid communication with the first end of the second air passage, and a second opening fixedly connected to and in fluid communication with the first air passage.

The first opening of the air inlet bag and the first end of the second air passage may be fixedly connected to each other by snap fit.

The seat may further comprise a seat tensioning member fixedly connected between the seat top sheet and the seat bottom sheet.

The first air passage may comprise a plurality holes therethrough and is disposed at the pool bottom of the pool body in an annular shape.

The seat and the first air passage are arranged substantially parallel to the pool bottom of the pool body.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
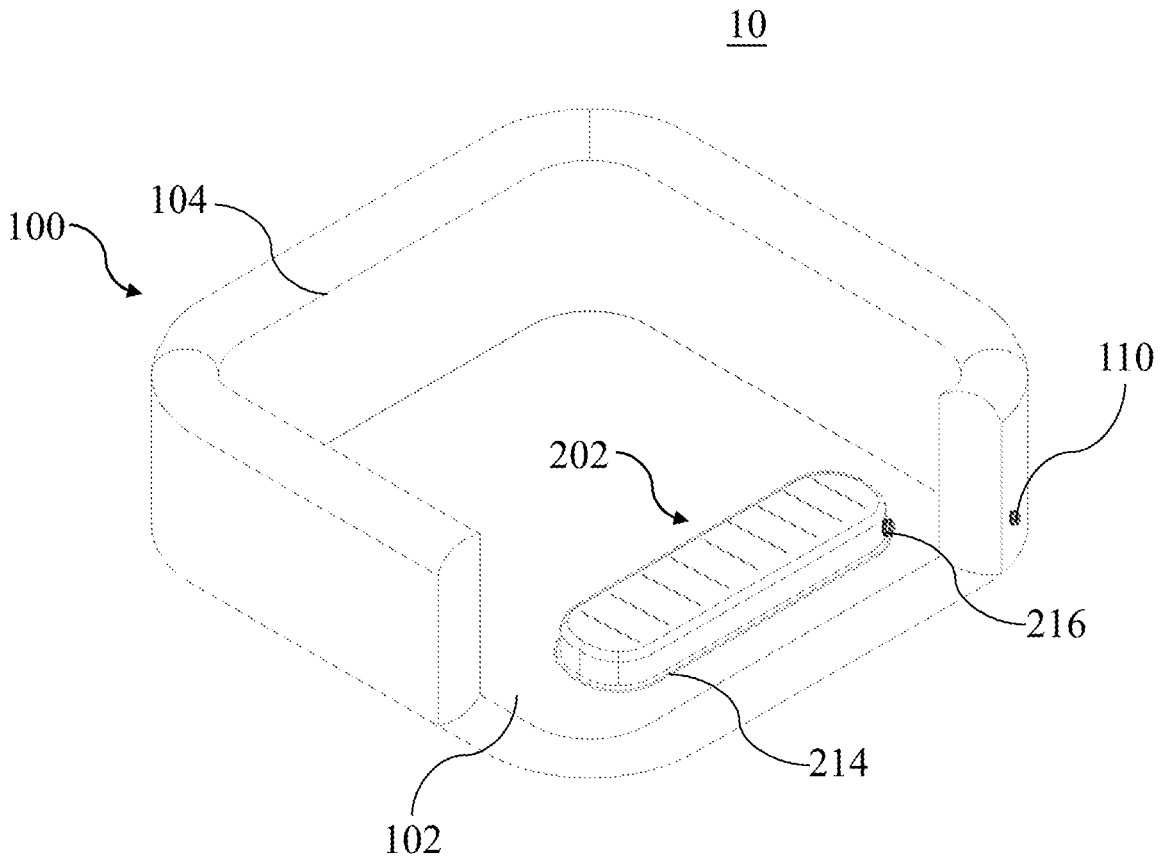
FIG. 1 is a perspective view of an inflatable pool according to a first aspect of a first example embodiment, with part of a side wall of the inflatable pool being omitted.
Figure 2:
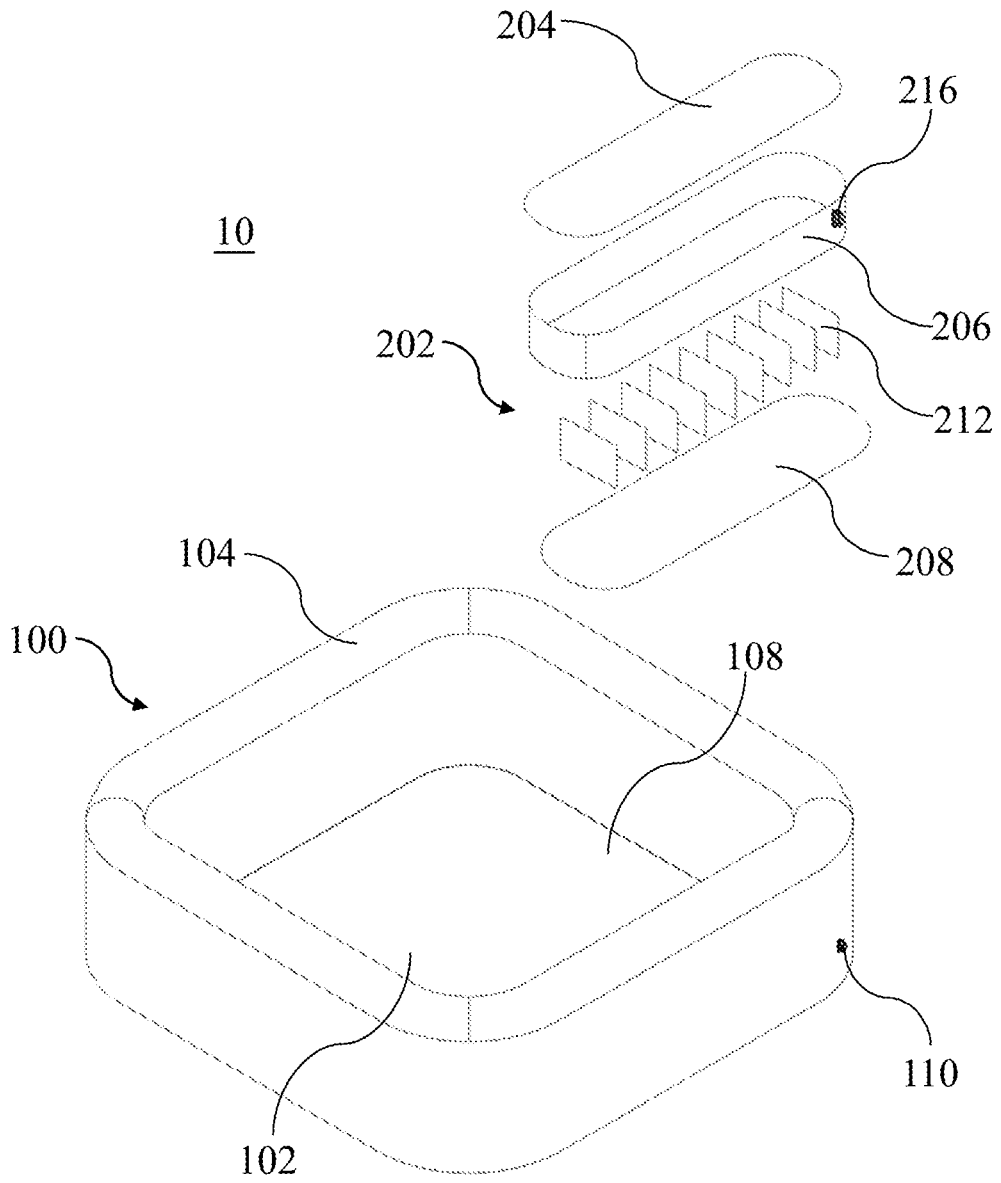
FIG. 2 is an exploded view of the inflatable pool according to the first aspect of the first example embodiment.
Figure 3A:
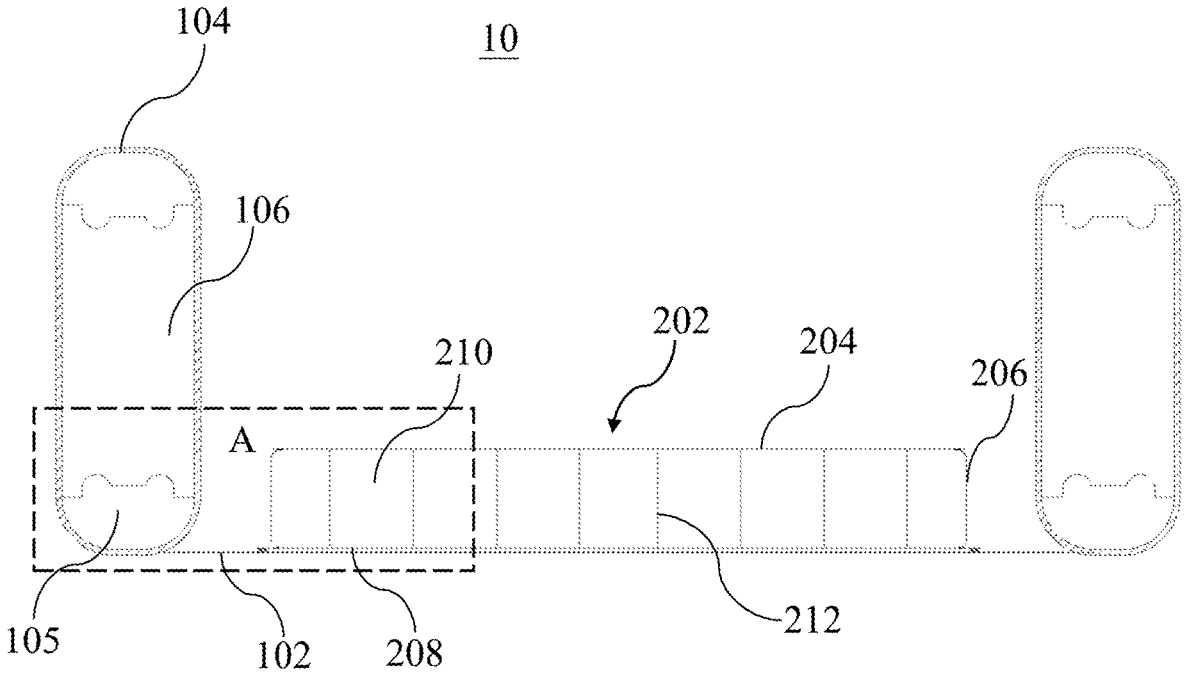
FIG. 3A is a sectional view of the inflatable pool according to the first aspect of the first example embodiment.
Figure 3B:
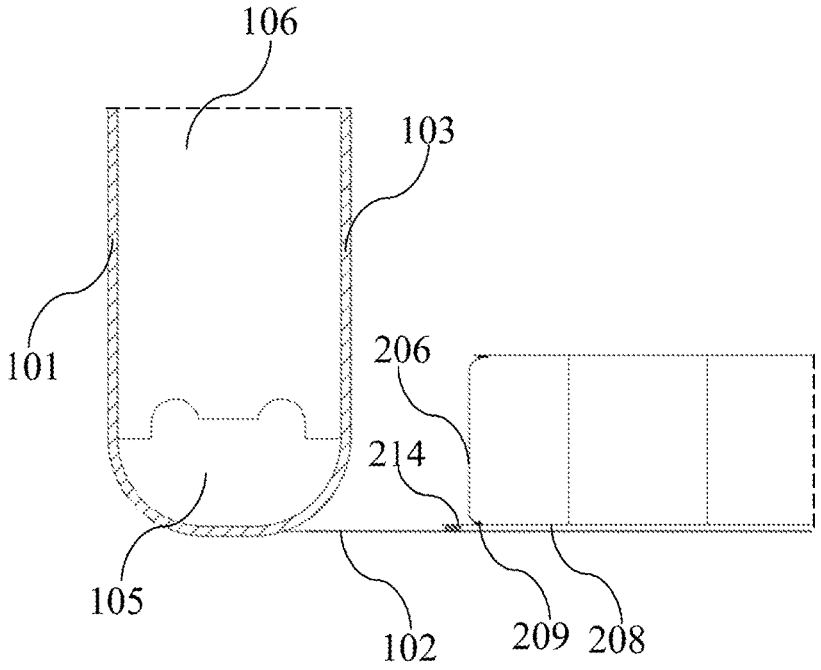
FIG. 3B is a partial enlarged view of region A of FIG. 3A.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these exemplary embodiments pertain may not be described here in detail.

FIGS. 1 to 4B show a structure of an inflatable pool according to a first aspect of a first example embodiment and a manufacturing method therefor.

Referring to FIGS. 1 to 3B, an inflatable pool 10 according to the first example of the first embodiment comprises a pool body 100 and a seat. Both the pool body 100 and the seat can be made of one or more flexible sheets. Each flexible sheet may be one of a polymer sheet (e.g., polyvinyl chloride), a rubber sheet, and a fabric, or a flexible sheet may be formed of multiple different materials.

The pool body 100 comprises a bottom wall 102 and a side wall 104. In the first aspect, the side wall 104 of the pool body 100 is inflatable, and the bottom wall 102 of the pool body 100 is not inflatable. It can be understood that, in one or more example embodiments, the bottom wall 102 may include an interlayer internally provided with an elastic porous material that can improve the comfort of the bottom wall 102. The side wall 104 may comprise an outer wall 101, an inner wall 103, and an internal space 105 defined by the outer wall 101 and the inner wall 103. A plurality of tensioning components 106 may be provided in the internal space 105. The tensioning components 106 may be strip-shaped or sheet-shaped, and opposite ends of each tensioning component 106 may be respectively connected to the outer wall 101 and the inner wall 103 of the side wall 104. When the side wall 104 is inflated until the pressure of the internal space is greater than the ambient atmospheric pressure, the tensioning components 106 tension the outer wall 101 and the inner wall 103 of the side wall 104, so that the side wall 104 maintains a preset shape and stands relative to the bottom wall 102 to form a water-holding space 108 together with the bottom wall 102. In the first aspect, the side wall 104 forms a substantially square shape around the bottom wall 102.

According to one or more example embodiments, the bottom wall 102 may be provided with an air channel and an air hole (not shown in the figure), the air channel being in communication with the water-holding space 108 via the air hole. The air channel may thereby be used to deliver pressurized air from an external air pump. The pressurized air may be released into the water held in the water-holding space 108 via the air hole, thereby forming bubbles to achieve a massage function.

The seat comprises an inflatable stool 202. The inflatable stool 202 is provided in the water-holding space 108. In the first aspect, the seat comprises one inflatable stool 202. It can be understood that the seat may alternately comprise more than one inflatable stool. The inflatable stool 202 comprises a top sheet 204, a side enclosure sheet 206, a bottom sheet 208, and an inflation chamber 210. A top edge and a bottom edge of the side enclosure sheet 206 are respectively connected to the top sheet 204 and the bottom sheet 208 to together define the inflation chamber 210. A plurality of tensioning members 212 are provided in the inflation chamber 210. The tensioning members 212 may be strip-shaped or sheet-shaped, and opposite ends of each tensioning member 212 may be respectively connected to a lower surface of the top sheet 204 and an upper surface of the bottom sheet 208. The connections between the top sheet 204, the side enclosure sheet 206, the bottom sheet 208, and the tensioning members 212 can be achieved by means of welding or bonding.

When the inflatable stool 202 is inflated until the pressure in the inflation chamber 210 is greater than the ambient atmospheric pressure, the tensioning members 212 tension the top sheet 204 and the bottom sheet 208, so that the inflatable stool 202 maintains a preset shape.

The bottom sheet 208 of the inflatable stool 202 may have an integral connecting portion 214 (referring to FIG. 1 and FIG. 3B) provided along an outer circumference of the inflatable stool 202, and the inflatable stool 202 may be fixedly connected to the bottom wall 102 of the pool body 100 via the connecting portion 214, so that the inflatable stool 202 is fixed in the pool body 100.

The connecting portion 214 is located along an outer circumferential side of a seam 209 between the bottom sheet 208 and the side enclosure sheet 206, and the connecting portion 214 is welded or bonded to the bottom wall 102. The connecting portion 214 may be formed at an outer circumferential edge of the bottom sheet 208 and extends along the entire circumference of the inflatable stool 202. In other words, the entire outer circumferential edge of the bottom sheet 208 is reserved as the connecting portion 214, and the connecting portion 214 is partially or fully connected to the bottom wall 102 of the pool body 100. For example, the connecting portion 214 may be discontinuously connected to the bottom wall 102 by means of welding or bonding, so that the connecting portion 214 is partially connected to the bottom wall 102. In this case, the water can enter the space between the bottom sheet 208 and the bottom wall 102 via the part of the connecting portion 214 that is not connected to the bottom wall 102, so that the inflatable stool 202 provides certain support for a user under the buoyancy of the water, thereby reducing the excessive local pressure of the inflatable stool 202 on the bottom wall 102. Alternately, the connecting portion 214 may be fully connected to the bottom wall 102, that is, the bottom sheet 208 of the inflatable stool 202 may be hermetically connected to the bottom wall 102 of the pool body 100 by means of welding or bonding over the entire outer circumferential edge thereof. In this case, the water in the water-holding space 108 of the pool body 100 cannot enter the space between the inflatable stool 202 and the bottom wall 102, so that the inflatable stool 202 will not be pulled by the buoyancy of the water, thereby limiting stress on the connecting between the inflatable stool 202 and the bottom wall 102.

The connecting portion of the bottom sheet 208 may comprise, in one or more example embodiments, a plurality of connecting sections spaced in the circumferential direction of the inflatable stool 202, and each of the plurality of connecting sections may be connected to the bottom wall 102 of the pool body 100. Alternately, the connecting portion may be formed at the bottom edge of the side enclosure sheet 206 and may be connected to the bottom wall 102 of the pool body 100.

In the first aspect, the side wall 104 and the inflatable stool 202 are respectively provided with a first inflation valve 110 and a second inflation valve 216 to allow the side wall 104 and the inflatable stool 202 to be inflated or deflated independently from one another. Alternately, the inflatable pool 10 may comprise a communication channel/communication opening, etc. for communication between the internal space 105 of the side wall 104 and the inflation chamber 210 of the inflatable stool 202, so as to allow simultaneous inflation or deflation of the side wall 104 and the inflatable stool 202. In this case, an inflation valve may be provided on only one of the side wall 104 and the inflatable stool 202.

As described above, in the first aspect, the bottom wall 102 of the pool body 100 is non-inflatable. Alternately, according to one or more example embodiments, the bottom wall 102 of the pool body 100 may be inflatable. In this case, the inflatable pool 10 may comprise a communication channel/communication opening for communication between the internal space of the bottom wall 102 and the inflation chamber 210 of the inflatable stool 202, so as to allow simultaneous inflation of the bottom wall 102 and the inflatable stool 202.

According to one or more example embodiments, the seat further comprises an inflatable backrest connected to the inflatable stool 202 to provide support for the head and back of the user when the user is sitting or lying on the inflatable stool 202, thereby providing a more comfortable experience. The inflatable backrest may be mounted to the inflatable stool 202 in an integrated manner or may be detachably mounted to the inflatable stool 202.

A manufacturing method of the inflatable pool according to the first aspect of the first example embodiment will be described below with reference to FIGS. 3A to 4B.

Figure 4A:
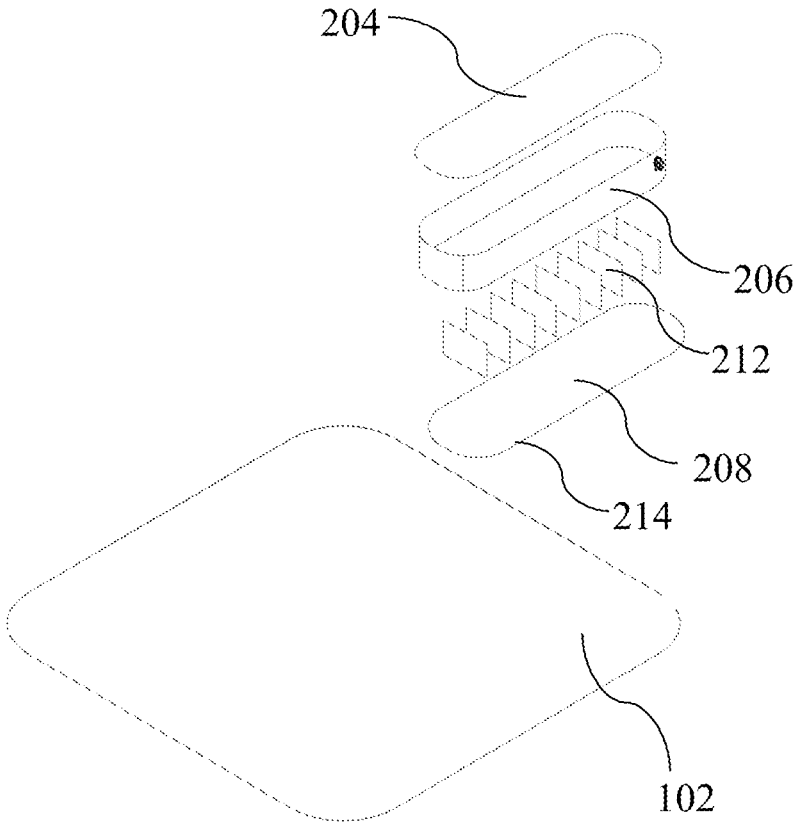
FIGS. 4A and 4B are schematic views of stages of a manufacturing method for the inflatable pool according to the first aspect of the first example embodiment.
Figure 4B:
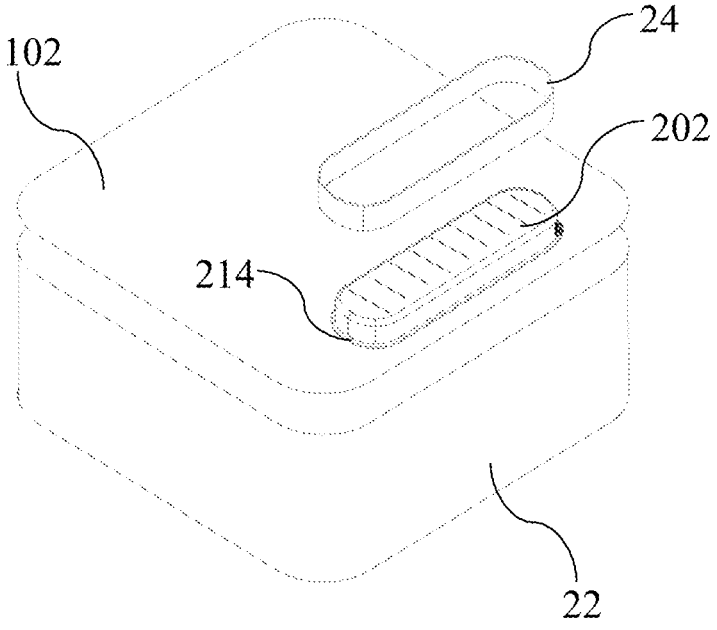

A manufacturing method of the inflatable pool 10 according to the first aspect may comprise: providing the bottom wall 102 of the pool body 100 and the top sheet 204, the side enclosure sheet 206, the bottom sheet 208 and the tensioning members 212 of the inflatable stool 202 (step a, as shown in FIG. 4A); and assembling the inflatable stool 202, so that the inflatable stool 202 is connected to the bottom wall 102 in a non-detachable manner via the connecting portion 214 (step b, as shown in FIG. 4B).

The bottom sheet 208 provided in the step a has the connecting portion 214 formed at the outer circumferential edge of the bottom sheet, and the connecting portion 214 extends along the entire circumference of the inflatable stool 202. In other words, the entire outer circumferential edge of the bottom sheet 208 is reserved as the connecting portion 214 that is configured to be connected to the bottom wall 102 of the pool body 100.

The step b may comprise: respectively connecting opposite ends of each tensioning member 212 to a lower surface of the top sheet 204 and an upper surface of the bottom sheet 208; connecting the bottom edge of the side enclosure sheet 206 to the bottom sheet 208, so that the connecting portion 214 of the bottom sheet 208 is located on the outer circumferential side of the seam 209 between the bottom sheet 208 and the side enclosure sheet 206; and connecting the top edge of the side enclosure sheet 206 to the top sheet 204. The top sheet 204, the bottom sheet 208 and the side enclosure sheet 206 will together define the inflation chamber 210 of the inflatable stool 202, and the tensioning members 212 are located in the inflation chamber 210. The step b may further comprise: allowing the connecting portion 214 of the bottom sheet 208 to be partially (e.g., discontinuously) or fully connected to the bottom wall 102 of the pool body 100 in a non-detachable manner, so that the inflatable stool 202 is fixed to the bottom wall 102.

As shown in FIG. 4B, the assembled inflatable stool 202 having an inflation chamber 210 may be placed on the bottom wall 102 in place, and on a machine base 22 of a welding apparatus, the connecting portion 214 of the inflatable stool 202 and the bottom wall 102 may be press-fitted and welded together by means of a copper mold 24 (which has an annular configuration and has a shape that matches the desired connecting portion 214 extending along the entire circumference of the inflatable stool 202) of the welding apparatus, so that the bottom sheet 208 of the inflatable stool 202 is hermetically connected to the bottom wall 102 of the pool body 100 by means of welding at the entire outer circumferential edge of the bottom sheet.

It can be understood that the connection sequence of the top sheet 204, the bottom sheet 208, the side enclosure sheet 206, the tensioning members 212, and the bottom wall 102 can be adjusted instead of being limited to a specific sequence; and the connections between the top sheet 204, the bottom sheet 208, the side enclosure sheet 206, the tensioning members 212 and the bottom wall 102 can be achieved by means of welding or bonding.

The manufacturing method may further comprise: providing the outer wall 101 and the inner wall 103 of the side wall 104, and assembling the side wall 104, so that the side wall 104 is connected to the bottom wall 102 (step c, not shown).

Figure 5:
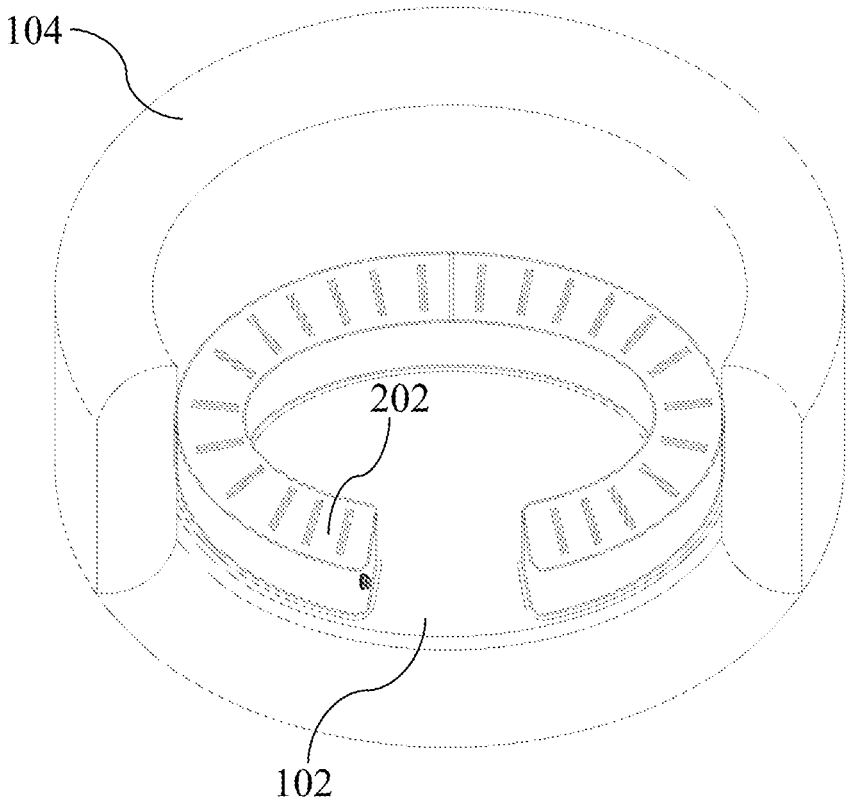
FIG. 5 is a perspective view of an inflatable pool according to a second aspect of the first example embodiment, with part of a side wall of the inflatable pool being omitted.
Figure 6:
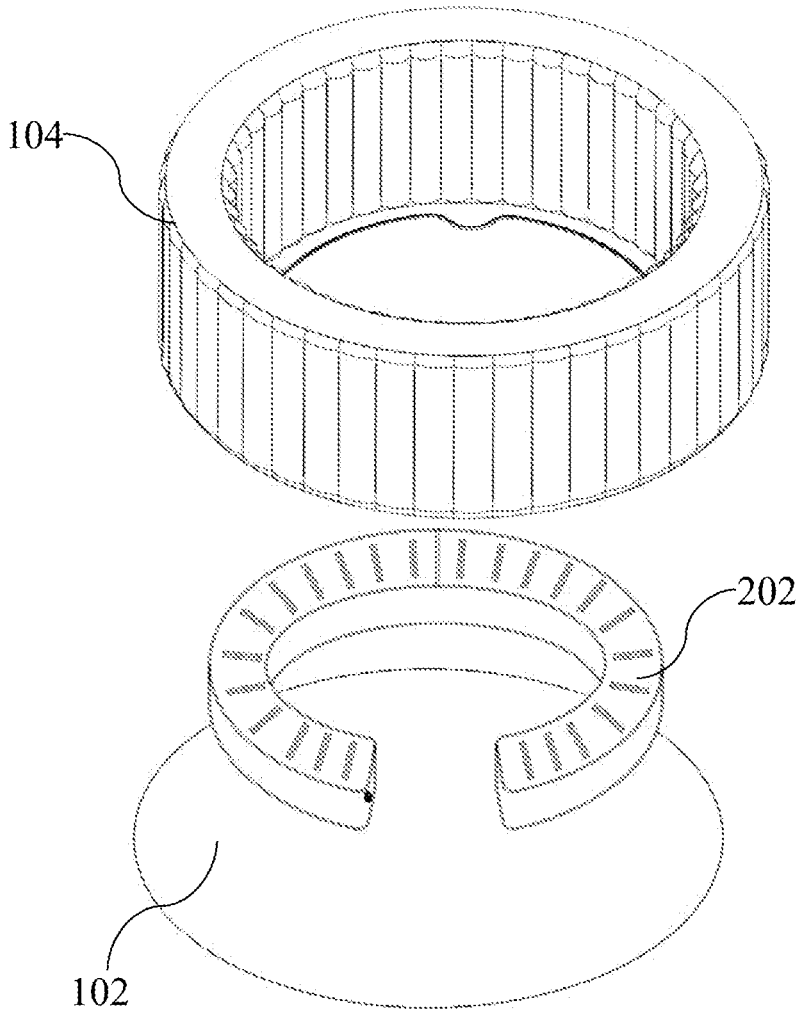
FIG. 6 is an exploded view of the inflatable pool according to the second aspect of the first example embodiment.
Figure 7:
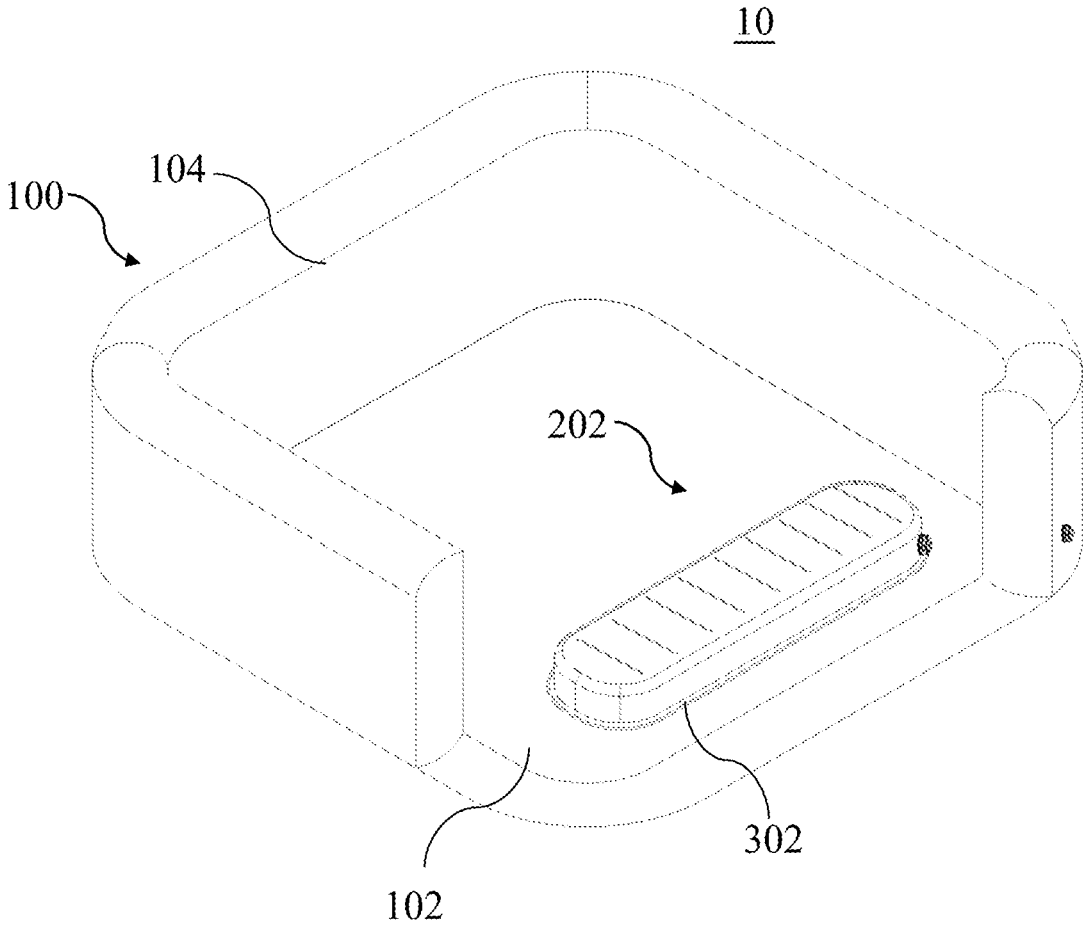
FIG. 7 is a perspective view of an inflatable pool according to a second example embodiment, with part of a side wall of the inflatable pool being omitted.
Figure 8:
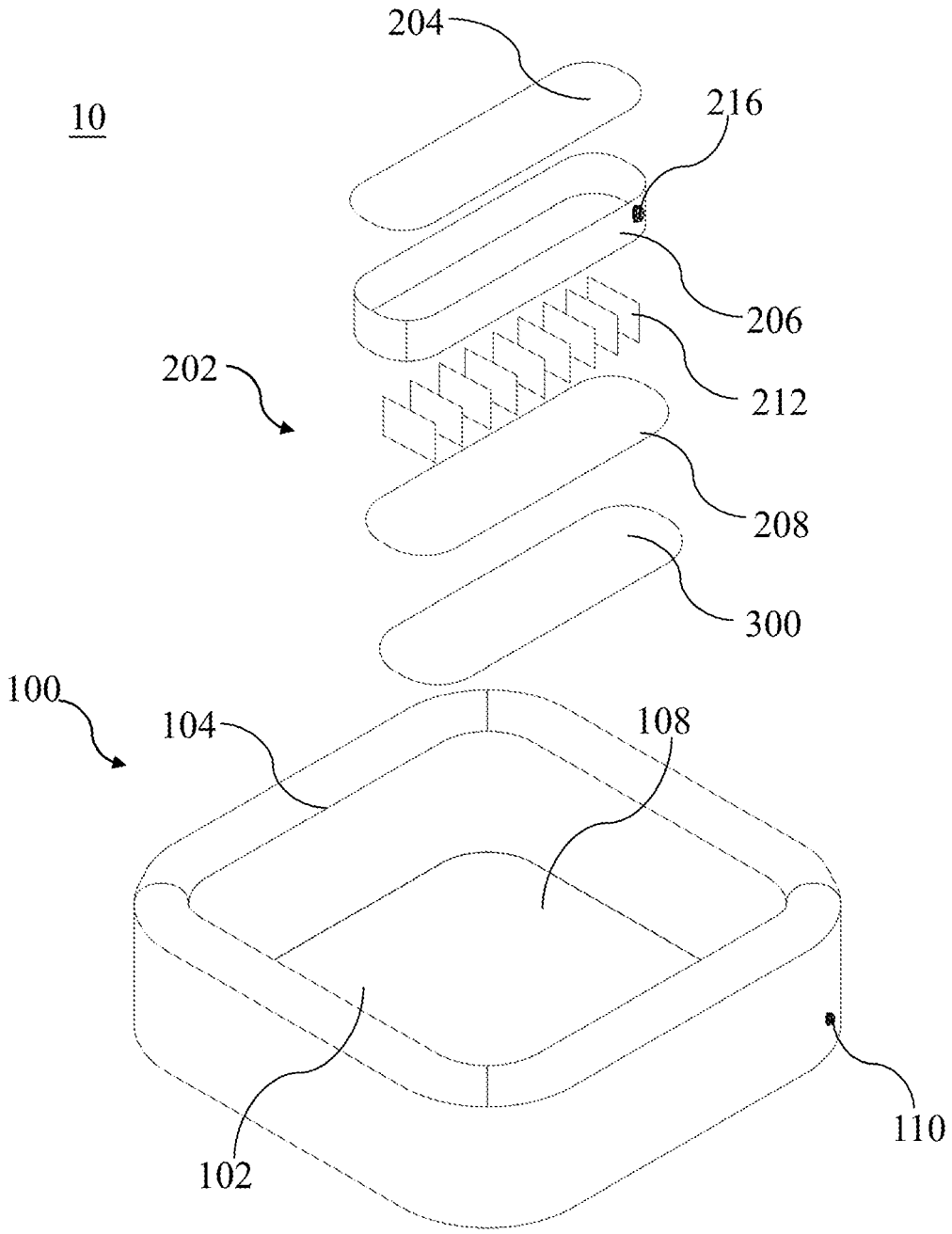
FIG. 8 is an exploded view of the inflatable pool according to the second example embodiment.
Figure 9A:
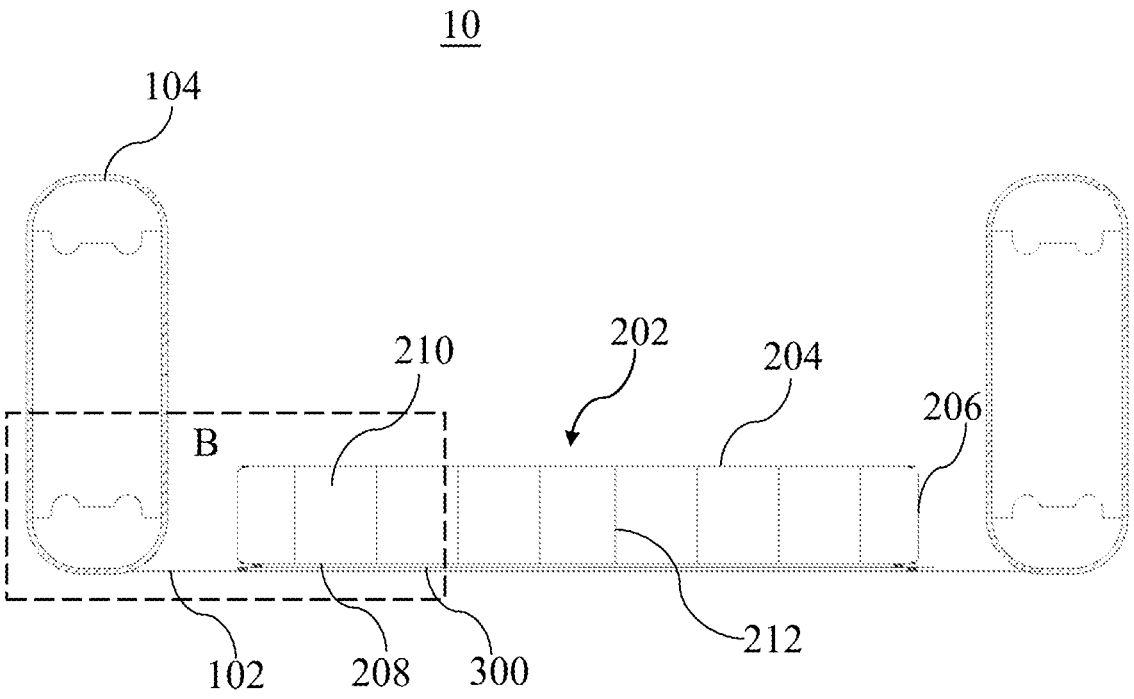
FIG. 9A is a sectional view of the inflatable pool according to the second example embodiment.
Figure 9B:
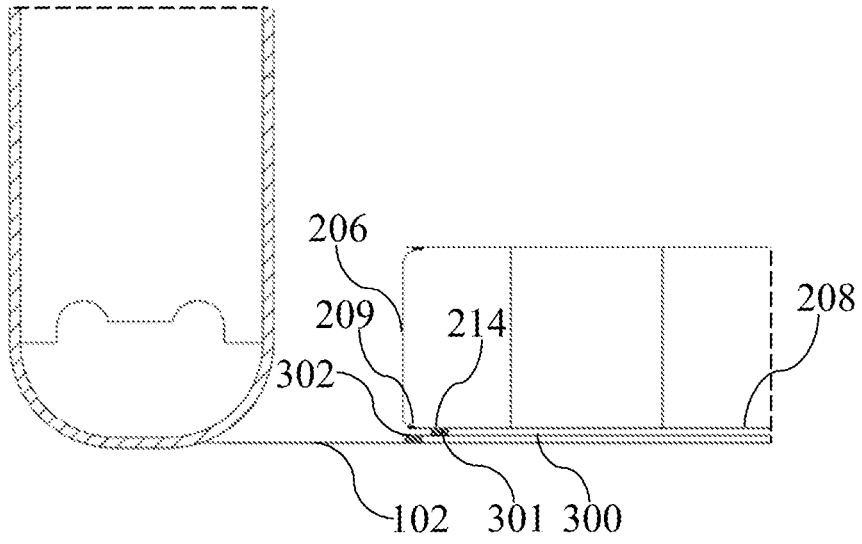
FIG. 9B is a partial enlarged view of region B pf FIG. 9A.

FIGS. 5 and 6 show a structure of an inflatable pool according to a second aspect of the first example embodiment. The inflatable pool according to the second aspect has substantially the same structure as the inflatable pool according to the first aspect, and has the difference only in that a side wall 104 of an inflatable pool 10 according to the second aspect forms a substantially circular shape around the bottom wall 102, and in that the inflatable stool 202 of the inflatable pool 10 according to the second aspect has an open, ring-shaped (i.e., substantially C-shaped) cross-section.

In addition to the shapes of the side walls and the inflatable stool shown in the first aspect and the aspect example, the side wall of the inflatable pool may alternately form an oval, triangular, rectangular, pentagonal, or other polygonal shape, or in any other appropriate shape, around the bottom wall; and the inflatable stool may also have a circular, oval, closed ring-shaped, triangular, square, rectangular, pentagonal, or other polygonal, or any other appropriate shape of cross-section.

Other example embodiments will be further described below, and the similarities between these example embodiments and the first example embodiment will not be repeated.

FIGS. 7 to 10B show a structure of an inflatable pool according to a second embodiment and a manufacturing method therefor.

Referring to FIGS. 7 to 9B, an inflatable pool 10 according to the second embodiment comprises a pool body 100 and a seat. The pool body 100 comprises a bottom wall 102 and a side wall 104. The bottom wall 102 and the side wall 104 together define a water-holding space 108. The seat comprises an inflatable stool 202. The inflatable stool 202 is disposed within the water-holding space 108. The inflatable stool 202 comprises a top sheet 204, a side enclosure sheet 206, a bottom sheet 208, and an inflation chamber 210. A top edge and a bottom edge of the side enclosure sheet 206 are respectively connected to the top sheet 204 and the bottom sheet 208, to together define the inflation chamber 210. The inflatable stool 202 further comprises tensioning members 212 provided in the inflation chamber 210, with opposite ends of each tensioning member 212 respectively connected to a lower surface of the top sheet 204 and an upper surface of the bottom sheet 208. The connections between the top sheet 204, the side enclosure sheet 206, the bottom sheet 208, and the tensioning member 212 can be achieved by means of welding or bonding.

The bottom sheet 208 of the inflatable stool 202 may have an integrally formed connecting portion 214 (referring to FIG. 9B) provided at a circumference of the inflatable stool 202. The inflatable pool 10 further comprises an attachment sheet 300 provided between the inflatable stool 202 and the bottom wall 102 of the pool body 100. In this second example embodiment, the attachment sheet 300 has substantially the same shape as the bottom sheet 208 of the inflatable stool 202. It can be understood that the attachment sheet 300 may alternately be ring-shaped or have any other appropriate shape, so that the attachment sheet 300 only covers a part of the bottom sheet 208. The attachment sheet 300 has an integrally formed attachment portion 302 (referring to FIGS. 7 and 9B) provided at a circumference of the inflatable stool 202.

In the second example embodiment, the connecting portion 214 is located on an inner peripheral side of a seam 209 between the bottom sheet 208 and the side enclosure sheet 206, and the connecting portion 214 is connected to the attachment sheet 300. The connecting portion 214 may extend along the entire circumference of the inflatable stool 202. The attachment portion 302 may be located on an outer circumferential side of a seam 301 between the connecting portion 214 and the attachment sheet 300, and the attachment portion 302 may be connected to the bottom wall 102.

The attachment portion 302 may be formed at an outer circumferential edge of the attachment sheet 300 and may extend along the entire circumference of the inflatable stool 202. In other words, the entire outer circumferential edge of the attachment sheet 300 may be reserved as the attachment portion 302, and the attachment portion 302 may be partially or fully connected to the bottom wall 102 of the pool body 100. For example, the attachment portion 302 may be discontinuously connected to the bottom wall 102 by means of welding or bonding, so that the attachment portion 302 is partially connected to the bottom wall 102. For another example, the attachment portion 302 may be fully connected to the bottom wall 102, that is, the attachment sheet 300 may be hermetically connected to the bottom wall 102 by means of welding or bonding at the entire outer circumferential edge of the attachment sheet.

According to one or more example embodiments, the attachment portion 302 may comprise a plurality of attachment sections spaced around the circumference of the inflatable stool 202, and each of the plurality of attachment sections may be connected to the bottom wall 102 of the pool body 100.

A manufacturing method for the inflatable pool according to the second example embodiment will be described below with reference to FIGS. 9A to 10B.

Figure 10A:
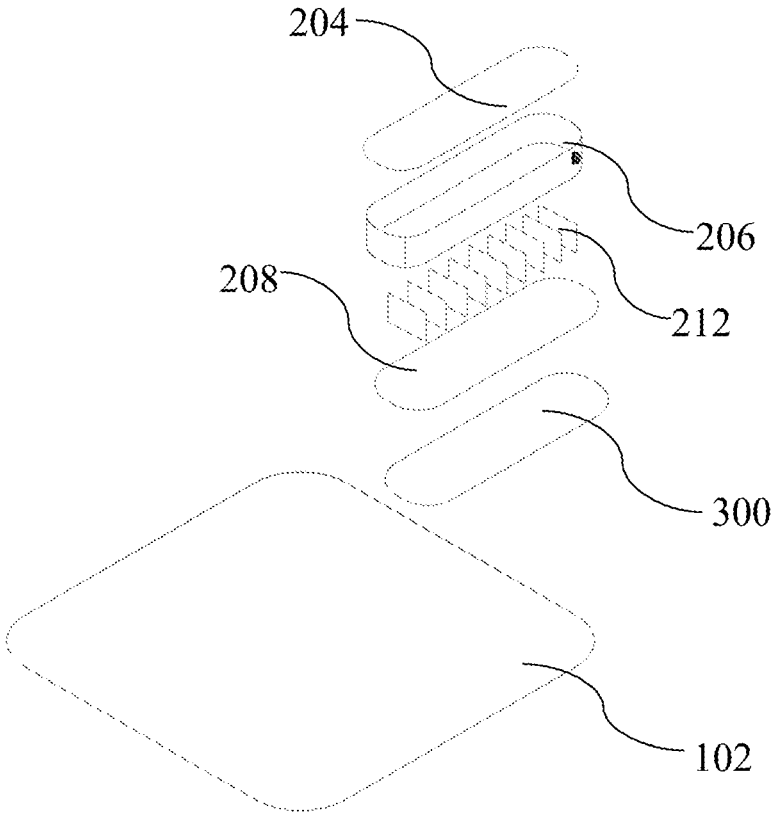
FIGS. 10A and 10B are schematic views of stages of a manufacturing method for the inflatable pool according to the second example embodiment.
Figure 10B:
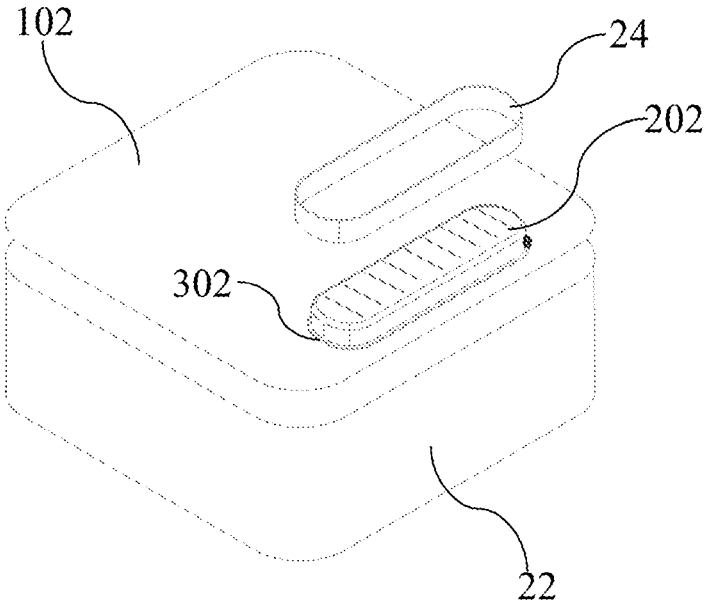
Figure 11:
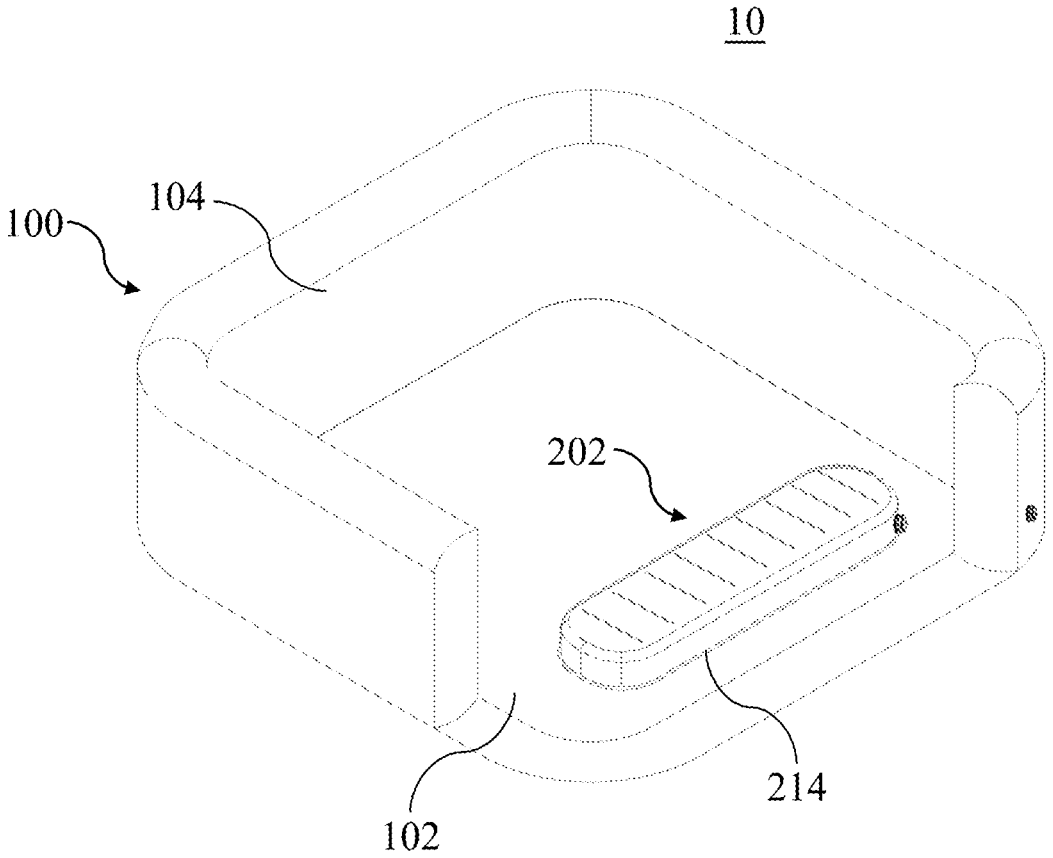
FIG. 11 is a perspective view of an inflatable pool according to a third example embodiment, with part of a side wall of the inflatable pool being omitted.
Figure 12:
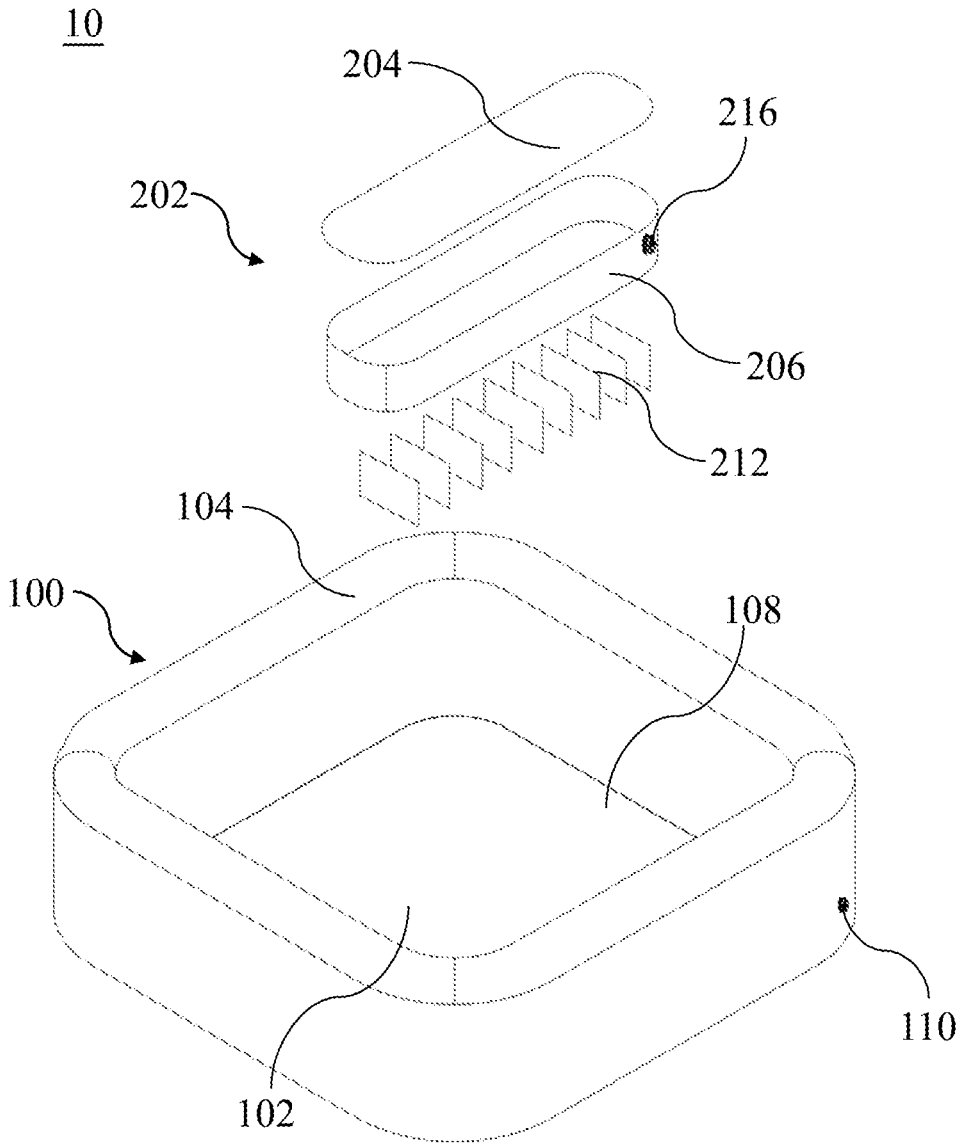
FIG. 12 is an exploded view of the inflatable pool according to the third example embodiment.
Figure 13A:
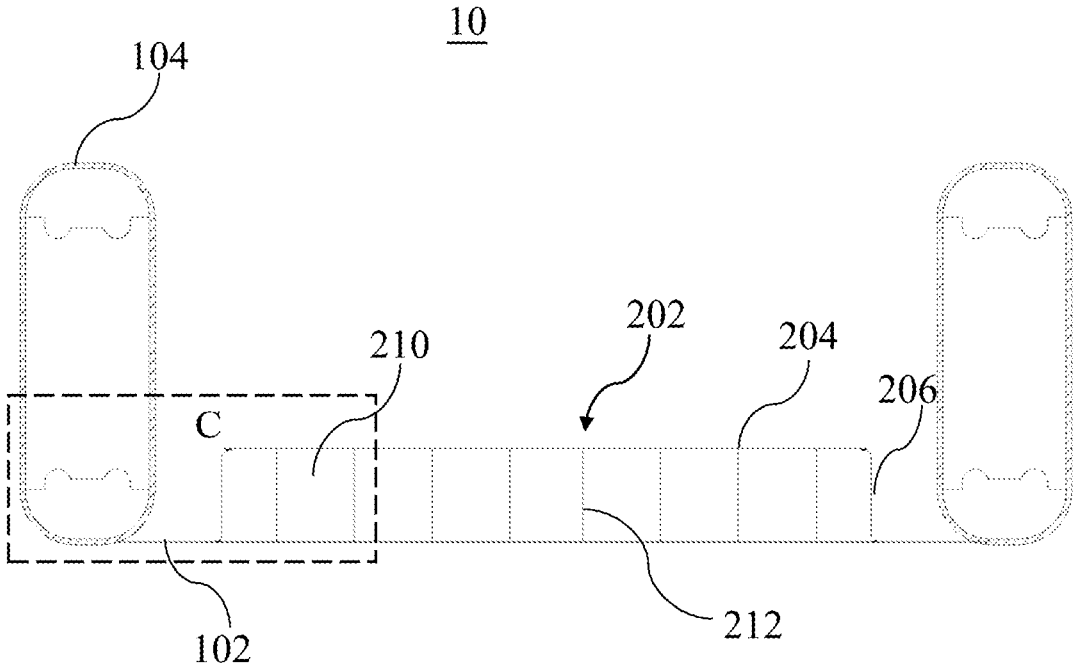
FIG. 13A is a sectional view of the inflatable pool according to the third example embodiment.
Figure 13B:
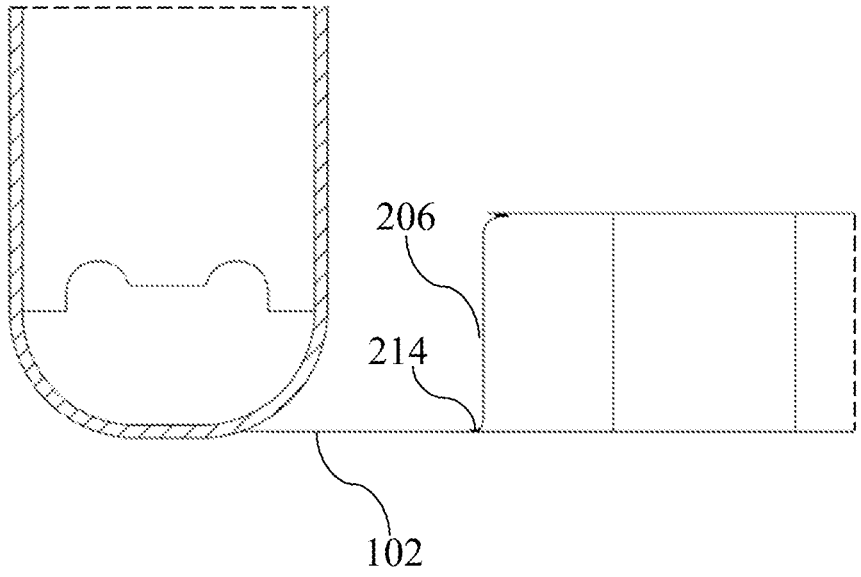
FIG. 13B is a partial enlarged view of region C pf FIG. 13A.

A manufacturing method for the inflatable pool 10 according to the second example embodiment may comprise: providing the bottom wall 102 of the pool body 100, the top sheet 204, the side enclosure sheet 206, the bottom sheet 208, and the tensioning member 212 of the inflatable stool 202, and the attachment sheet 300 (step a, as shown in FIG. 10A); and assembling the inflatable stool 202, so that the inflatable stool 202 is connected to the bottom wall 102 in a non-detachable manner via the attachment sheet 300 (step b, as shown in FIG. 10B).

The bottom sheet 208 provided in step a has the connecting portion 214 extending along the entire circumference of the inflatable stool 202. The attachment sheet 300 provided in the step a has the attachment portion 302 formed at the outer circumferential edge of the attachment sheet, and the attachment portion 302 extends along the entire circumference of the inflatable stool 202. In other words, the entire outer circumferential edge of the attachment sheet 300 is reserved as the attachment portion 302 that is configured to be connected to the bottom wall 102 of the pool body 100.

The step b may comprise: respectively connecting opposite ends of each tensioning member 212 to a lower surface of the top sheet 204 and an upper surface of the bottom sheet 208; connecting a lower surface of the connecting portion 214 of the bottom sheet 208 to the attachment sheet 300, so that the attachment portion 302 is located on an outer circumferential side of the seam 301 between the connecting portion 214 and the attachment sheet 300; connecting the bottom edge of the side enclosure sheet 206 to the bottom sheet 208, so that the connecting portion 214 of the bottom sheet 208 is located on the inner peripheral side of the seam 209 between the bottom sheet 208 and the side enclosure sheet 206; and connecting the top edge of the side enclosure sheet 206 to the top sheet 204. The top sheet 204, the bottom sheet 208 and the side enclosure sheet 206 will together define the inflation chamber 210 of the inflatable stool 202, and the tensioning members 212 are located in the inflation chamber 210. The step b may further comprise: allowing the attachment portion 302 of the attachment sheet 300 to be partially (e.g., discontinuously) or fully connected to the bottom wall 102, so that the inflatable stool 202 is fixed to the bottom wall 102.

As shown in FIG. 10B, the inflatable stool 202 and the attachment sheet 300 connected to each other may be placed on the bottom wall 102 in place, and on a machine base 22 of a welding apparatus, the attachment portion 302 of the attachment sheet 300 and the bottom wall 102 are press-fitted and welded together by means of a copper mold 24 (which has a shape that matches the attachment portion 302 of the attachment sheet 300) of the welding apparatus. In this way, the inflatable stool 202 is connected to the bottom wall 102.

It can be understood that the connection sequence of the top sheet 204, the bottom sheet 208, the side enclosure sheet 206, the tensioning member 212, the attachment sheet 300 and the bottom wall 102 can be adjusted instead of being limited to a specific sequence; and the connections between the top sheet 204, the bottom sheet 208, the side enclosure sheet 206, the tensioning member 212, the attachment sheet 300 and the bottom wall 102 can be achieved by means of welding or bonding.

The manufacturing method may further comprise: providing components of the side wall 104, and assembling the side wall 104, so that the side wall 104 is connected to the bottom wall 102 (step c, not shown).

FIGS. 11 to 14B show a structure of an inflatable pool according to a third example embodiment and a manufacturing method therefor.

Referring to FIGS. 11 to 13B, an inflatable pool 10 according to the third embodiment comprises a pool body 100 and a seat. The pool body 100 comprises a bottom wall 102 and a side wall 104. The bottom wall 102 and the side wall 104 together define a water-holding space 108. The seat comprises an inflatable stool 202. The inflatable stool 202 is provided in the water-holding space 108. The inflatable stool 202 comprises a top sheet 204, a side enclosure sheet 206, and an inflation chamber 210. The side enclosure sheet 206 may have an integrally formed connecting portion 214 (referring to FIGS. 11 and 13B) provided at a circumference of the inflatable stool 202. The connecting portion 214 is formed at a bottom edge of the side enclosure sheet 206 and can extend along the entire circumference of the inflatable stool 202. In other words, the entire bottom edge of the side enclosure sheet 206 may be reserved as the connecting portion 214 that is configured to be connected to the bottom wall 102 of the pool body 100. A top edge of the side enclosure sheet 206 is connected to the top sheet 204, and the connecting portion 214 of the side enclosure sheet 206 is connected to the bottom wall 102 to together define the inflation chamber 210. The inflatable stool 202 further comprises tensioning members 212 provided in the inflation chamber 210, with opposite ends of the tensioning member 212 being respectively connected to a lower surface of the top sheet 204 and an upper surface of the bottom wall 102. The connections between the top sheet 204, the side enclosure sheet 206, the tensioning member 212 and the bottom wall 102 can be achieved by means of welding or bonding.

In this case, the water in the water-holding space 108 of the pool body 100 cannot enter the space between the inflatable stool 202 and the bottom wall 102, so that the inflatable stool will not be stressed due to the buoyancy of the water, thereby preventing the connection between the inflatable stool 202 and the bottom wall 102 from being stressed. In addition, it is not necessary to form an air chamber of the inflatable stool 202 in advance with a plurality of walls and then mount the inflatable stool 202 to the bottom wall 102. Instead, the bottom wall 102 is also used as one of the walls of the inflatable stool 202, thus saving materials and reducing the production cost of the inflatable pool.

The manufacturing method for the inflatable pool according to a third example embodiment will be described below with reference to FIGS. 13A to 14B.

Figure 14A:
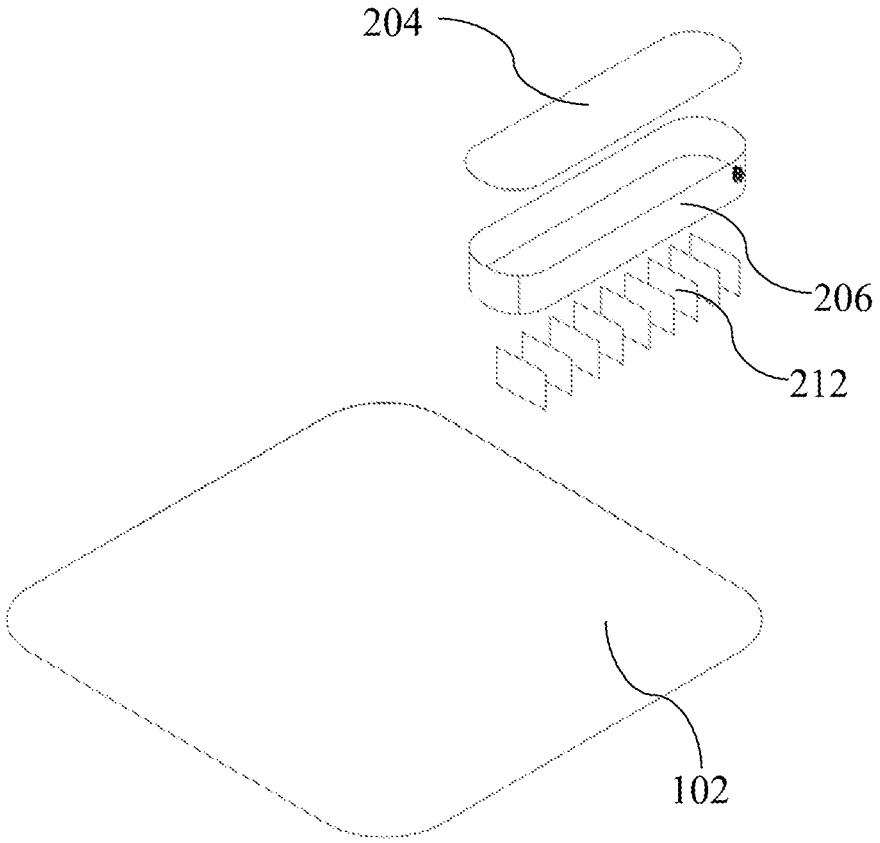
FIGS. 14A and 14B are schematic views of stages of a manufacturing method for the inflatable pool according to the third example embodiment.
Figure 14B:
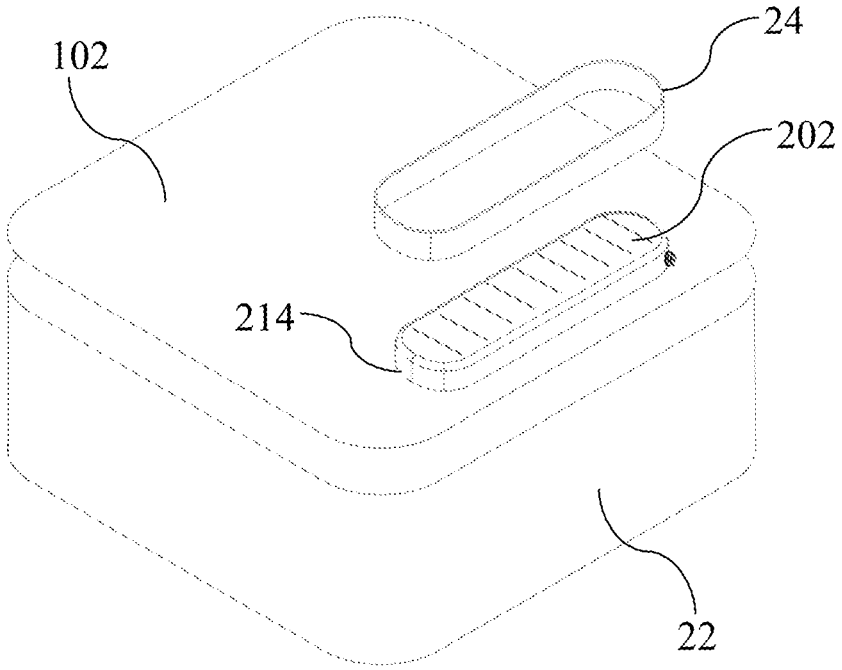

The manufacturing method for the inflatable pool 10 according to the third example embodiment may comprise: providing the bottom wall 102 of the pool body 100 and the top sheet 204, the side enclosure sheet 206, and the tensioning member 212 of the inflatable stool 202 (step a, as shown in FIG. 14A); and assembling the inflatable stool 202, so that the inflatable stool 202 is connected to the bottom wall 102 in a non-detachable manner (step b, as shown in FIG. 14B).

The side enclosure sheet 206 provided in the step a has the connecting portion 214 formed at the bottom edge of the side enclosure sheet, and the connecting portion 214 extends along the entire circumference of the inflatable stool 202. In other words, the entire bottom edge of the side enclosure sheet 206 may be reserved as the connecting portion 214 that is configured to be connected to the bottom wall 102 of the pool body 100. The step b may comprise: respectively connecting opposite ends of each tensioning member 212 to a lower surface of the top sheet 204 and an upper surface of the bottom wall 102; connecting the top edge of the side enclosure sheet 206 to the top sheet 204; and connecting the connecting portion 214 of the side enclosure sheet 206 to the bottom wall 102, so that the top sheet 204, the side enclosure sheet 206 and the bottom wall 102 together define the inflation chamber 210 of the inflatable stool 202, and the tensioning members 212 are located in the inflation chamber 210. In this way, the inflatable stool 202 is fixed to the bottom wall 102 of the pool body 100 at the same time as the inflation chamber 210 forming the inflatable stool 202 is assembled.

As shown in FIG. 14A, the tensioning member 212 may be welded to the top sheet 204 and the bottom wall 102, and the side enclosure sheet 206 may be welded to the top sheet 204; and then, on a machine base 22 of a welding apparatus, the connecting portion 214 of the side enclosure sheet 206 and the bottom wall 102 are press-fitted and welded together by means of a copper mold 24 (which has a shape that matches the connecting portion 214 of the side enclosure sheet 206) of the welding apparatus. In this way, the inflatable stool 202 is connected to the bottom wall 102 at the same time as the inflatable stool 202 is assembled.

It can be understood that the connection sequence of the top sheet 204, the side enclosure sheet 206, the tensioning member 212, and the bottom wall 102 can be adjusted instead of being limited to a specific sequence; and the connections between the top sheet 204, the side enclosure sheet 206, the tensioning member 212 and the bottom wall 102 can be achieved by means of welding or bonding.

The manufacturing method may further comprise: providing components of the side wall 104, and assembling the side wall 104, so that the side wall 104 is connected to the bottom wall 102 (step c, not shown).

Figure 15A:
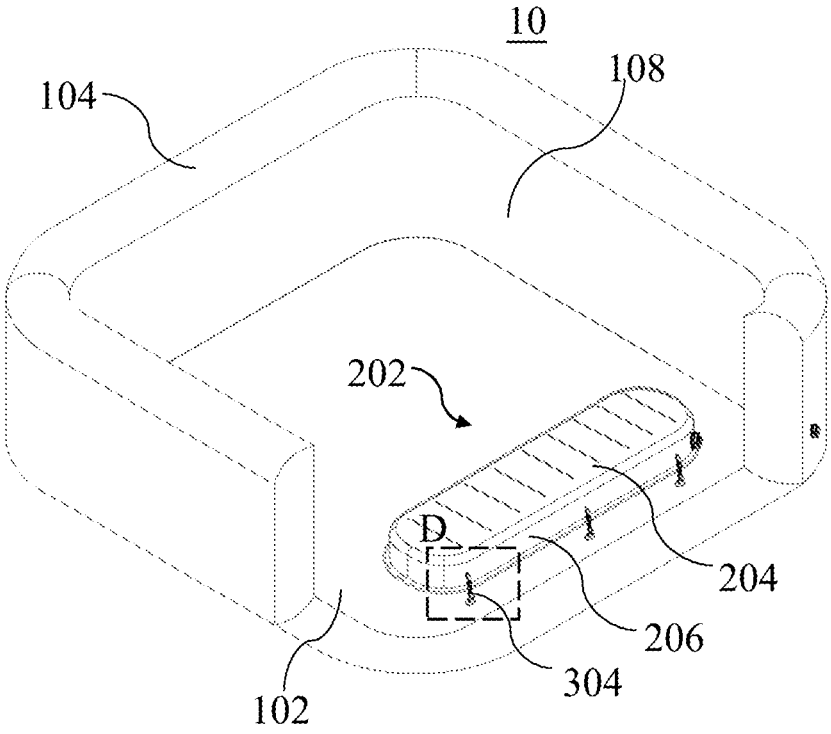
FIG. 15A is a perspective view of an inflatable pool according to a fourth example embodiment, with part of a side wall of the inflatable pool being omitted.
Figure 15B:
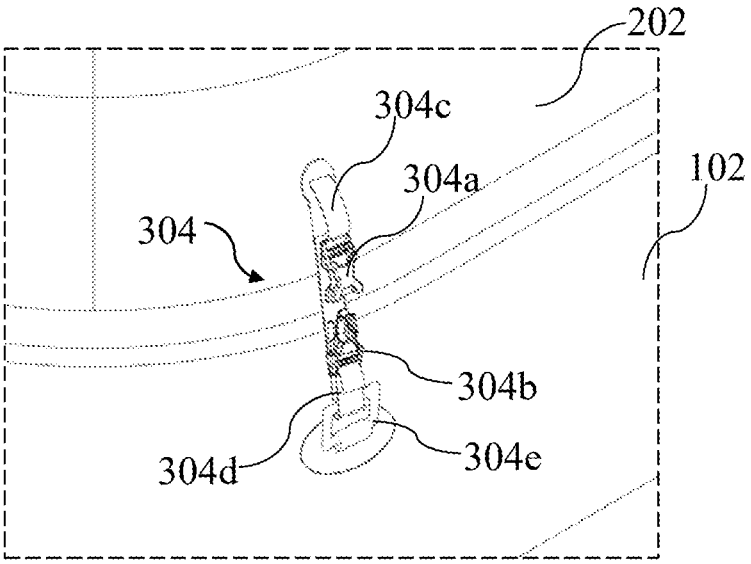
FIG. 15B is a partial enlarged view of region D of FIG. 15A.

FIG. 15 shows a structure of an inflatable pool according to a fourth example embodiment. Referring to FIG. 15, an inflatable pool 10 according to the fourth example embodiment comprises a pool body 100 and a seat. The pool body 100 comprises a bottom wall 102 and a side wall 104. The bottom wall 102 and the side wall 104 together define a water-holding space 108. The seat comprises an inflatable stool 202. The inflatable stool 202 is provided in the water-holding space 108. The inflatable stool 202 comprises a top sheet 204, a side enclosure sheet 206, a bottom sheet (not shown), and an inflation chamber (not shown). A top edge and a bottom edge of the side enclosure sheet 206 are respectively connected to the top sheet 204 and the bottom sheet to together define the inflation chamber. The inflatable stool 202 further comprises tensioning members (not shown) provided in the inflation chamber, with opposite ends of the tensioning member being respectively connected to the top sheet 204 and the bottom sheet. The connections between the top sheet 204, the side enclosure sheet 206, the bottom sheet and the tensioning member can be achieved by means of welding or bonding. The inflatable stool 202 may be connected to the bottom wall 102 in a detachable manner. In the fourth example embodiment, the inflatable stool 202 is connected to the bottom wall 102 of the pool body 100 by means of one or more attachment assemblies (e.g., a release buckle assembly 304, referring to FIGS. 15A and 15B). Specifically, the release buckle assembly 304 may comprise a first attachment component 304*a* and a second attachment component 304*b* cooperating with each other. For example, one of the first attachment component 304*a* and the second attachment component 304*b* may be a male buckle, and the other may be a female buckle. The first attachment component 304*a* is fixed to the inflatable stool 202 by means of a third attachment component 304*c* (e.g., including a nylon tape), and the second attachment component 304*b* is fixed to the inflatable stool 202 by means of a fourth attachment component 304*d* (e.g., including a nylon tape). The release buckle assembly 304 may further comprise a ring buckle 304*e* provided on the bottom wall 102. The fourth attachment component 304*d* may pass through the ring buckle 304*e*, and the fourth attachment component 304*d* may have an adjustable length, so as to allow the distance between the inflatable stool 202 and the bottom wall 102 to be adjusted.

According to one or more example embodiments, the third attachment component 304*c* may have an adjustable length. In other example embodiments, both the third attachment component 304*c* and the fourth attachment component 304*d* may have an adjustable length. According to one or more example embodiments, the first attachment component 304*a* may be fixed to the inflatable stool 202 via the third attachment component (e.g., including the nylon tape), and the second attachment component 304*b* may be fixed to the bottom wall 102 via the fourth attachment component (e.g., including the nylon tape).

It can be understood that the attachment assembly may include a hook-and-loop fastener, one or more zippers, a fastening strap, or one of other implementations.

Figure 16:
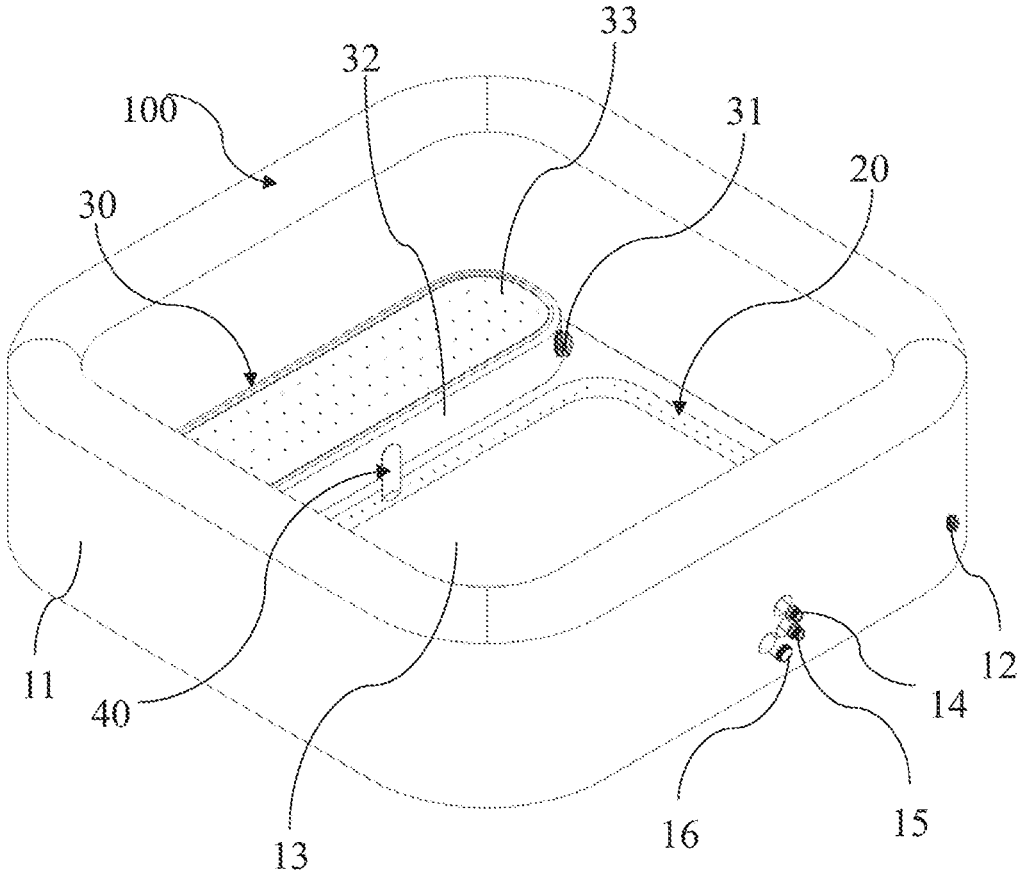
FIG. 16 is a schematic diagram of the appearance of a massage pool according to a fifth example embodiment.
Figure 18:
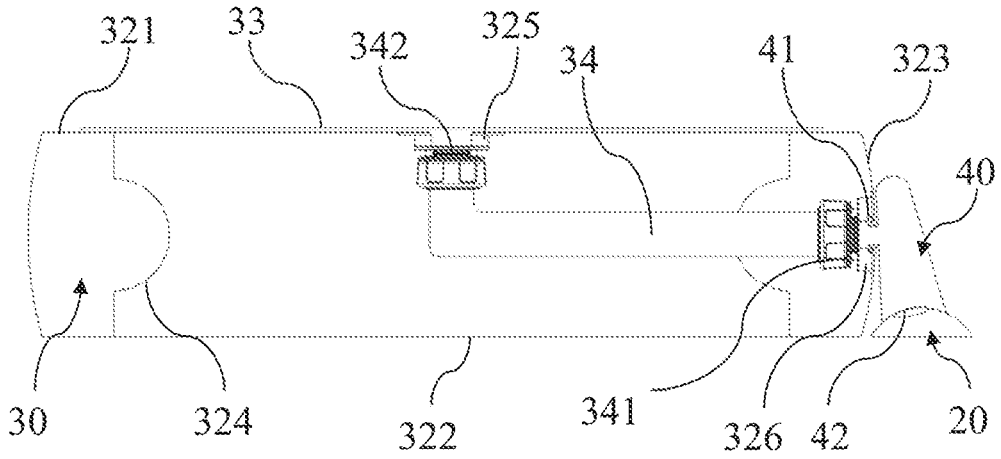
FIG. 18 is a schematic cross-sectional view of a seat and a connection between a second air passage of the seat and a first air pipe of a pool body.

FIGS. 16 and 18 illustrate a massage pool according to a fifth example embodiment. The massage pool comprises a pool body 100, and the pool body 100 comprises a pool wall 11 and a pool bottom 13 that constitute a closed first air chamber, and water-holding space defined by the pool wall 11 and the pool bottom 13. The first air chamber is inflated and deflated by means of a first air valve 12. A first air passage 20 is provided at the bottom (pool bottom 13) of the pool body 100. The pool wall 11 is provided with a water inlet pipe 14 and a water outlet pipe 15, and an air inlet pipe 16 that is in communication with the first air passage 20 via a first interface 221. The air inlet pipe 16 is connected to an air pump, not shown, to pump air into the first air passage 20. According to one or more example embodiments, the first air passage 20 is provided with a plurality of through holes 21 to form a first bubble-generating passage, and the air may be injected into the water through the through holes 21 in the first bubble-generating passage to form wave-making bubbles, thereby providing a massage effect to a user. In FIG. 16, the first air passage 20 is shown as a substantially quadrangular ring, which is not limiting. Depending on different needs, the first air passage may be any shape, including, but not limited to a closed ring, an open ring, a circular ring, or other polygonal ring. Similarly, a massage pool in a substantially square shape is taken as a non-limiting example, but any of a variety of other shapes, such as circles or other polygons, are not excluded.

Optionally, the pool body and the first air passage may be made of a hot-meltable material such as a polyvinyl chloride (PVC (material or a PVC composite material, the pool wall and the pool bottom may be connected to form the pool body by hot-melt welding, etc., and the first air passage may be formed at the pool bottom.

In the example embodiment shown in FIG. 16, a seat 30 is provided on the pool bottom 13 of the pool body 10. The seat 30 is, for example, an inflatable seat, and comprises a seat wall 32 to form a second air chamber independent of the first air chamber. The second air chamber is inflated and deflated by means of a second air valve 31. As discussed, for example, with respect to one or more of the above-described example embodiments, the seat may be fixed to the pool bottom, that is, the two are integrated formed, but have separate air chambers; or the seat can be detachably connected to the pool bottom by means of a connecting means. The seat 30 may be provided with a seat bubble-generating sheet 33. The seat bubble-generating sheet may be arranged on the seat wall 32 and/or a top outer surface of the seat to provide a massage effect to a specific body part of the user. The seat bubble-generating sheet may be arranged on the top outer surface of the seat, may be adapted to the contour of the top outer surface, and may be provided with a second air passage 34 that is in fluid communication with the first air passage 20. The seat bubble-generating sheet 33 may be provided with a plurality of through holes 331. After air enters the second air passage 34 through the first air passage 20, it can flow to and be sprayed out through the plurality of through holes 331, so as to form wave-making bubbles above the seat 30 to provide a massage effect to the user using the seat 30.

It should be understood that the seat specifically described herein is not intended to be limiting, and can cover any of various forms suitable for users to relax in the pool, such as an inflatable bench, an inflatable reclining chair, and an inflatable bench with a backrest or headrest.

According to one or more example embodiments, a gap is provided between the seat bubble-generating sheet 33 and the top outer surface of the seat 30 to form a second bubble-generating passage. Correspondingly, the first bubble-generating passage is formed in the first air passage 20 on the pool bottom of the pool body. With reference to the example shown in FIG. 18, the second air passage 34 may be disposed in the second air chamber of the inflatable seat. Specifically, the second air chamber of the seat 30 may be configured to be enclosed by a seat top sheet 321, a seat bottom sheet 322 and a seat surrounding sheet 323 in a sealed manner. A first end 341 of the second air passage 34 may be fixedly connected to the seat surrounding sheet 323, and a second end 342 of the second air passage 34 may be fixedly connected to the seat top sheet 321. The seat top sheet 321 and the seat surrounding sheet 323 each may have a communicating hole that is in fluid communication with the second air passage 34.

In this example embodiment, the second air passage 34 is configured in the form of a pipe, the first end 341 and the second end 342 of which are provided with a connection interface, so as to be fixedly connected to a mounting connector 326 on the seat surrounding sheet 323 and a mounting connector 325 on the seat top sheet 321, respectively, by means of a threaded fastener.

The seat 30 and the first air passage 20 may be arranged in parallel at the pool bottom 13 of the pool body. The term "parallel" here refers to that the first bubble-generating passage of the first air passage does not interfere with the second bubble-generating passage of the seat, so that the bubble-generating range can be spread throughout the pool to the greatest extent. It should be understood that depending on different needs, the shape and/or position and/or number of the seat and the shape and/or position and/or number of the first air passage can be modified. For example, the first air passage may be arranged around the seat, or a plurality of seats may be arranged around the first air passage, or a plurality of first air passages may be spaced apart from the seat, or a plurality of first air passages and a plurality of seats are arranged in a one-to-one correspondence with each other in a surrounding manner, which are not exhaustively listed here.

Since the seat bubble-generating sheet 33 is provided on the seat 30 and the seat bubble-generating sheet 33 is provided with a plurality of through holes 331, after entering the first air passage 20, air enters the second air passage 34 and flows to the through holes 331 while being sprayed out through the through holes 21 of the first air passage 20, so that bubbles can be sprayed out of both the first air passage and the seat, massaging all parts of the body regardless of whether the user is sitting on the seat or lying on the seat.

Figure 17:
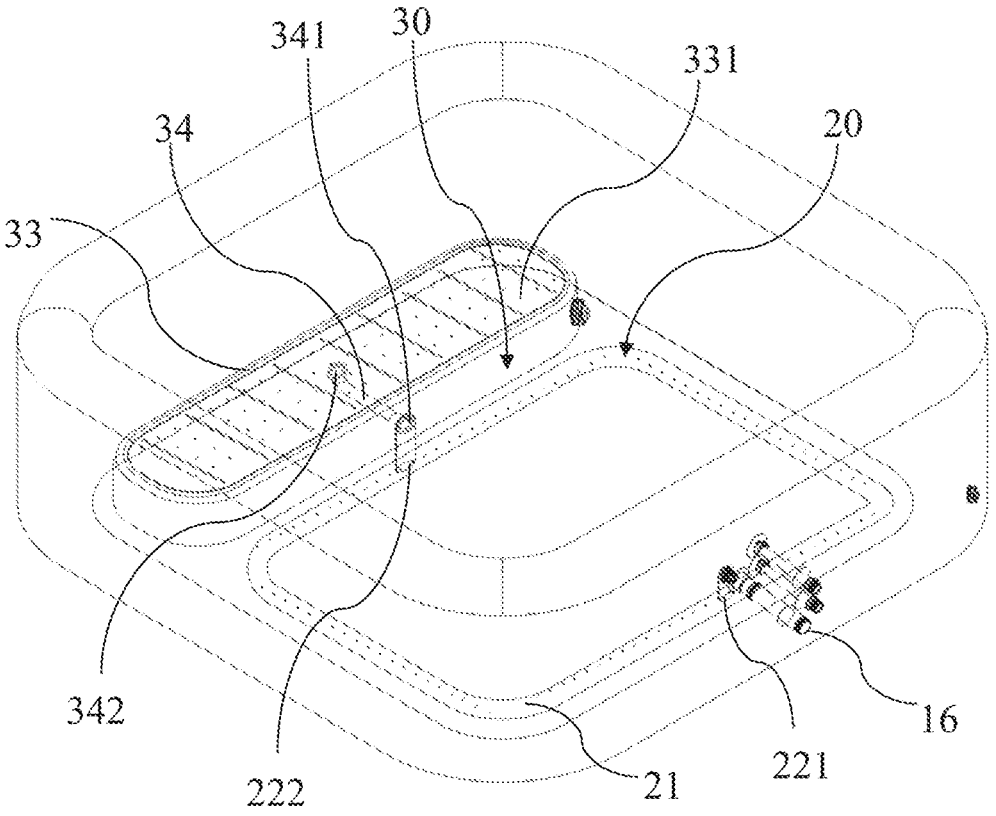
FIG. 17 is a schematic diagram of the massage pool in FIG. 16, with internal structures of a pool wall and a seat being shown in a transparent manner.

The first air passage 20 is in fluid communication with the second air passage 34 by means of an air inlet bag 40. The air inlet bag 40 has a first opening 41 and a second opening 42. The first opening 41 is in fluid communication with the first end 341 of the second air passage 34, and the second opening 42 is in fluid communication with a second interface 222 (FIG. 17) of the first air passage 20. Optionally, the air inlet bag is made of a hot-meltable material such as a PVC material or a PVC composite material.

Optionally, the seat and the seat bubble-generating sheet thereon are made of a hot-meltable material such as a PVC material or a PVC composite material. A second bubble-generating passage is formed between the seat top sheet and the seat bubble-generating sheet by connecting the periphery of the seat bubble-generating sheet to the seat top sheet in a melted manner. Optionally, the second air passage is made of a PVC material or other plastic material, for example, it is a pipe composed of a PVC film.

According to one or more example embodiments, the first opening 41 of the air inlet bag 40 and the first end 341 of the second air passage 34 are fixedly connected to each other by snap fit, as shown in FIG. 18. In this way, a detachable and convenient connection between the air inlet bag 40 and the seat can be implemented in some cases. For example, when the seat is not fixed to the pool bottom, the seat can be disassembled for maintenance and replacement or replaced with different forms of seats according to different needs, which helps to expand the versatility of the massage pool.

Figure 19:
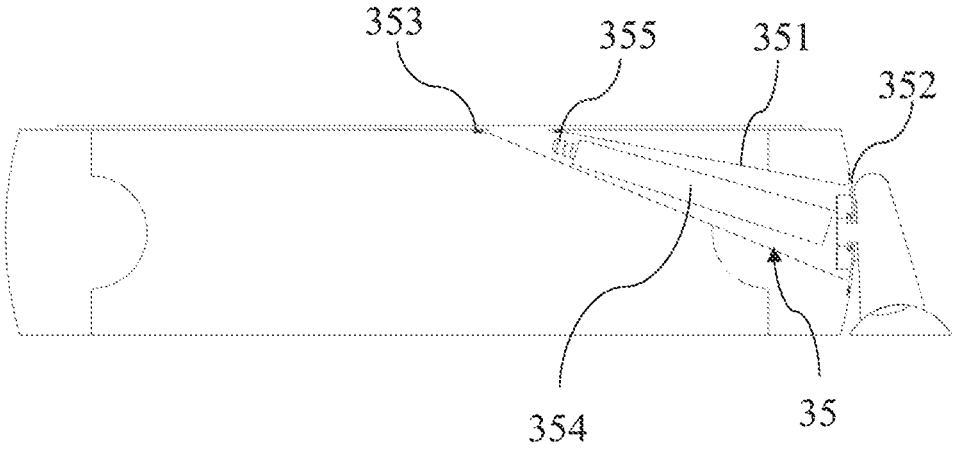
FIG. 19 is similar to FIG. 18, showing another example embodiment of a second air passage.

FIG. 19 shows a second air passage 35 according to another embodiment. In this embodiment, the second air passage 35 is configured to comprise a sleeve 351 and a pipe 354 provided inside the sleeve 351. A first end 352 and a second end 353 of the sleeve 351 are respectively connected to the seat surrounding sheet and seat top sheet by welding. Similar to FIG. 18, the air inlet bag can still be fixedly connected to the seat surrounding sheet by snap fit.

The pipe 354 may have a hardness greater than the hardness of the sleeve 351, that is, the sleeve may be made of a soft or flexible materials such as a PVC material or a laminated PVC mesh material. The pipe may be made of a material with a higher hardness than the sleeve material, including but not limited to silicone, metal, hard alloy, hard rubber, etc. In this way, the pipe 354 functions as a supporting tube for supporting the sleeve 351 to prevent the sleeve 351 from being squashed due to an air pressure in the seat, thereby ensuring that the air can smoothly pass through the second air passage.

According to one or more example embodiments, an air outlet nozzle 355 is provided at an end of the pipe 354 facing the seat top sheet. In this way, the communicating holes in the seat top sheet or the through holes in the seat bubble-generating sheet can be prevented from blockage which results in that the air cannot be smoothly sprayed out. As shown in FIG. 19, the air outlet nozzle 355 is optionally provided with a plurality of air holes to facilitate uniform spraying-out of the air.

According to one or more example embodiments, the seat 30 further comprises a seat tensioning member 324. As shown in FIG. 18, a plurality of seat tensioning members 324 are connected between the seat top sheet 321 and the seat bottom sheet 322. Alternatively, the seat tensioning members are made of a hot-meltable material such as a PVC material or a PVC composite material (such as a laminated PVC mesh material), and are connected, in a melted manner, to the seat top sheet, the seat bottom sheet, and the seat surrounding sheet that are also made of a hot-meltable material to form an inflatable seat in a specific seat shape, and the seat tensioning members have a function of stabilizing the inflated shape of the seat.

It should also be understood that the components and features described herein can be made of a variety of materials including, but not limited to, polymer, rubber, metal, and other suitable materials or combinations thereof well known to those skilled in the art. The embodiments shown in FIGS. 1 to 19 only show the shapes, dimensions, and arrangements of the optional components of an example inflatable pool. However, the example embodiments are merely illustrative but not restrictive, and other shapes, dimensions and arrangements may also be employed without departing from the idea and scope of the example embodiments.

It may be understood that the exemplary embodiments described herein may be considered in a descriptive sense only and not for purposes of limitation. Descriptions of features or aspects within each exemplary embodiment may be considered as available for other similar features or aspects in other exemplary embodiments.

While exemplary embodiments have been described with reference to the figures, it will be understood by those of ordinary skill in the art that various changes in form and details may be made therein without departing from the spirit and scope as defined by the following claims.

What is claimed is:

1. A pool comprising:

a pool body having:

a side wall;

a bottom wall connected to the side wall;

a water cavity defined by the bottom wall and the side wall; and an inflatable stool disposed in the water cavity and having a side enclosure sheet having a top edge and a bottom edge;

a top sheet connected to the top edge of the side enclosure sheet;

a bottom sheet connected to the bottom edge of the side enclosure sheet along a first welding seam and comprising a connecting portion, the connection portion extending along an outer circumferential side of the first welding seam and hermetically connected to the bottom wall along a second welding seam; and an inflation chamber defined by the top sheet, the side enclosure sheet, and the bottom sheet.

2. The inflatable pool according to claim 1, wherein opposite sides of the side enclosure sheet are respectively connected to the top sheet and the bottom sheet.

3. The inflatable pool according to claim 2, wherein the connecting portion is a circumferential extension of the bottom sheet disposed along an outer circumferential side of a seam between the bottom sheet and the side enclosure sheet.

4. The inflatable pool according to claim 3, the connecting portion is a circumferential extension of the bottom sheet and extends along an entire circumference of the inflatable stool.

5. The inflatable pool according to claim 2, wherein the connecting portion is a circumferential extension of the bottom sheet;

wherein the inflatable pool further comprises an attachment sheet disposed between the inflatable stool and the bottom wall, and comprising an integral attachment portion shaped to correspond to a shape of the connecting portion, wherein the attachment portion is disposed along an outer circumferential side of the seam between the connecting portion and the attachment sheet, and wherein the attachment portion is connected to the bottom wall.

6. The inflatable pool according to claim 5, wherein both the connecting portion and the attachment portion extend along an entire circumference of the inflatable stool.

7. The inflatable pool according to claim 1, wherein the connecting portion comprises an extension of the side enclosure sheet.

8. The inflatable pool according to claim 1, wherein:

opposite sides of the side enclosure sheet are respectively connected to the top sheet and the bottom sheet; and the inflatable stool detachably connected to the bottom wall.

9. The inflatable pool according claim 1, wherein the inflatable stool further comprises a tensioning member disposed within the inflation chamber and connected to the top sheet and to one of the bottom sheet and the bottom wall.

10. A method for manufacturing an inflatable pool comprising:

providing a pool body comprising a bottom wall;

providing a top sheet, a bottom sheet, and a side enclosure sheet of an inflatable stool;

assembling the inflatable stool such that an inflation chamber of the inflatable stool is defined by the top sheet and the side enclosure sheet, a connecting portion is disposed along a circumference of the inflatable stool, and the bottom sheet is hermetically connected to an outer circumferential edge of the bottom wall of the pool body; and connecting the connecting portion to the bottom wall.

* * * * *